US005330007A

United States Patent [19]

Collins et al.

[11] Patent Number: 5,330,007

[45] Date of Patent: Jul. 19, 1994

[54] TEMPLATE AND PROCESS FOR DRILLING AND COMPLETING MULTIPLE WELLS

[75] Inventors: Gary J. Collins, Richmond; John L. Baugh; Wilhelm E. Benker, both of Houston, all of Tex.

[73] Assignee: Marathon Oil Company, Findlay, Ohio

[21] Appl. No.: 80,042

[22] Filed: Jun. 18, 1993

Related U.S. Application Data

[63] Continuation-in-part of Ser. No. 936,972, Aug. 28, 1992.

[51] Int. Cl.[5] ..... E21B 15/04; E21B 7/08; E21B 43/01

[52] U.S. Cl. ..... 166/313; 166/341; 166/345; 166/349; 166/366; 175/61

[58] Field of Search ..... 166/313, 366, 382, 381, 166/359, 341, 342, 345; 175/78, 79, 61

[56] References Cited

U.S. PATENT DOCUMENTS

| | | | |
|---|---|---|---|
| 2,492,079 | 12/1949 | Wiley | 166/117.5 |
| 3,080,922 | 3/1963 | Mater | 166/313 |
| 3,083,768 | 4/1963 | Althouse, Jr. et al. | 166/313 X |
| 3,118,502 | 1/1964 | Cochran | 166/313 X |
| 3,170,518 | 2/1965 | Brown | 166/313 |
| 3,330,360 | 7/1967 | Young | 166/313 X |
| 4,068,729 | 1/1978 | Peevey | 166/366 X |
| 4,291,724 | 9/1981 | Miller | 166/366 X |
| 4,396,075 | 8/1983 | Wood et al. | 175/79 |
| 5,145,004 | 9/1992 | Cornette | 166/313 X |

FOREIGN PATENT DOCUMENTS

| | | | |
|---|---|---|---|
| 0136935A1 | 4/1985 | European Pat. Off. . | |
| 2229117 | 1/1974 | Fed. Rep. of Germany . | |
| 1254866 | 1/1961 | France | 166/313 |
| 2220015A | 12/1989 | United Kingdom . | |

*Primary Examiner*—Stephen J. Novosad

[57] ABSTRACT

A template and process for drilling and completing multiple wells in a subterranean formation. A template having a plurality of axially extending, divergent bores therethrough is secured to surface or intermediate casing and a like plurality of subterranean wells are drilled through the bores and into the subterranean formation. Each well is separately cased to the well head at the surface and separate production tubing is inserted into each well. Thus, remedial operations can be carded out in one well or fluid injected into a subterranean formation via one well while fluid, such as hydrocarbons, are simultaneously produced from a subterranean formation via the other well(s).

72 Claims, 18 Drawing Sheets

FIG. 3
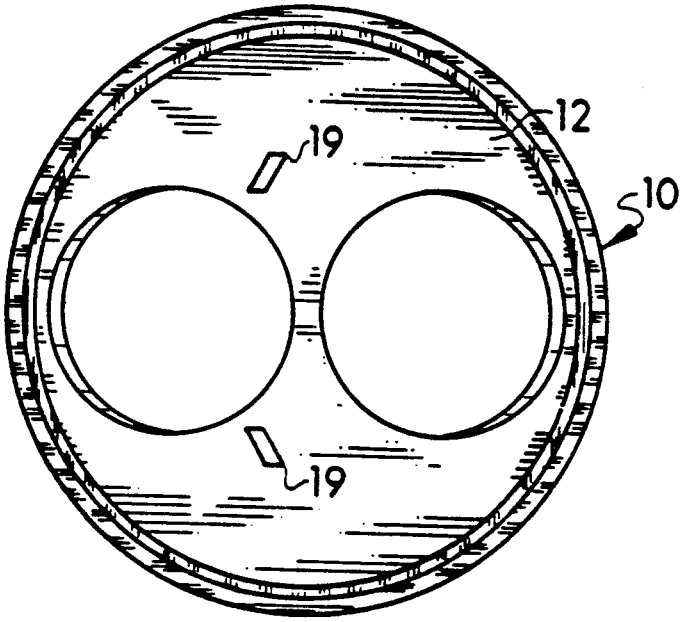
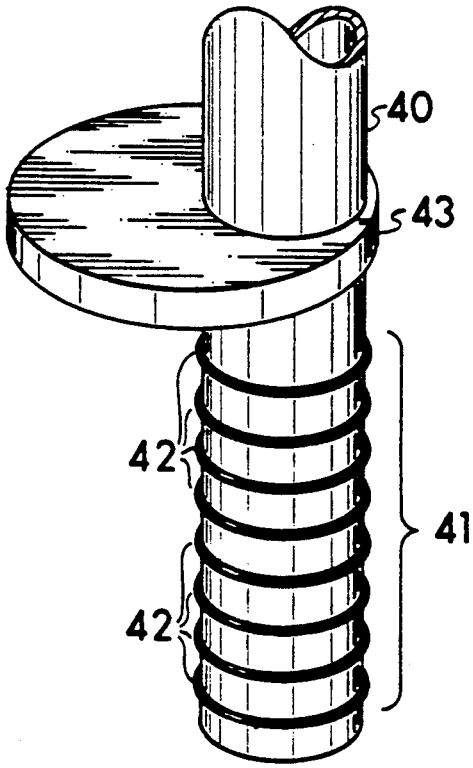
FIG. 4

TEMPLATE AND PROCESS FOR DRILLING AND COMPLETING MULTIPLE WELLS

CROSS-REFERENCE TO RELATED APPLICATIONS

This application is a continuation-in-part of copending U.S. patent application, Ser. No. 07/936,972, filed Aug. 28, 1992.

BACKGROUND OF THE INVENTION

1. Field of the Invention

The present invention relates to a template and process for drilling multiple subterranean wells from a single vertical or deviated cased well bore and for completing such wells via separate casings positioned within the well bore, and more particularly, to a template and process for drilling and completing such multiple wells which will permit remedial operations to be conducted in one well while fluid, such as hydrocarbons, are simultaneously being produced from a subterranean formation and/or fluid is simultaneously being injected into the subterranean formation via the other well(s).

2. Description of Related Art

Increasingly, well bores are being drilled into subterranean formations at an orientation which is purposely deviated from true vertical by means of conventional whipstock technology or a mud motor secured in the drill string adjacent the drill bit. In fractured subterranean formations, deviated wells are utilized to increase the area of drainage defined by the well within the subterranean formation, and thus, increase production of hydrocarbons from the subterranean formation. An inherent problem in utilizing a conventional whipstock to drill a deviated well is that both the depth and radial orientation of the whipstock is set when the whipstock is positioned in the well bore and cannot be changed without retrieving the whipstock from the well bore and changing the depth and/or radial orientation thereof.

In addition, wells drilled from offshore drilling platforms are usually deviated to increase the number of wells which can be drilled and completed from a single platform. Offshore drilling platforms which are utilized in deep water to drill and complete wells in a subterranean formation vary in size, structure, and cost depending upon the water depth and the loads in which the platform will be set. For example, a platform may be constructed to be supported in part by one leg or caisson which extends to the ocean floor or by as many as eight such legs or caissons. Costs of such offshore drilling platforms vary from approximately $5,000,000 to $500,000,000. Each offshore drilling platform is equipped with a set number of slots via which deviated wells can be drilled and completed through surface casing which is secured at the mudline by conventional techniques. Due to the significant capital expenditure required for these offshore platforms, a need exists for a template and process for drilling and completing multiple cased wells via a single surface or intermediate casing.

Accordingly, it is an object of the present invention to provide a template and process for drilling and completing multiple wells within a subterranean formation via a single surface or intermediate casing and for completing such multiple wells via separate casings positioned through the surface or intermediate casing.

It is another object of the present invention to complete such multiple, cased wells in a manner such that remedial operations can be conducted on one well while hydrocarbons from the subterranean formation are simultaneously being produced from the other wells which are completed via separate casings positioned within the same surface or intermediate casing.

It is a further object of the present invention to provide a template and process for drilling multiple cased wells from a single surface or intermediate casing without the use of a whipstock.

It is a still further object of the present invention to provide such a template for drilling multiple cased wells from a single surface or intermediate casing which is relatively simple in construction, which permits casing of each multiple well to separately depend from the template, and which provides that the separate casing of each multiple well extend to the surface.

SUMMARY OF THE INVENTION

To achieve the foregoing and other objects, and in accordance with the purposes of the present invention, as embodied and broadly described herein, one characterization of the present invention may comprise a template for drilling and completing multiple subterranean wells from a first casing. The template comprises a body having a first end face and at least one second end face and a plurality of axially extending bores therethrough and means for securing the body to the first casing. Each of the bores intersects the first end face and the second end face of the template body.

In another characterization of the present invention, a process is provided for drilling and completing subterranean wells via a first casing which extends from the surface of the earth to a predetermined depth. The process comprises securing a template having at least two divergent bores therethrough to the first casing, drilling a first subterranean well bore through one of the bores and into a subterranean formation, and securing a first length of production casing to the template. The first length of production casing extends into the first well bore and is supported by the template.

In yet another characterization of the present invention, a method is provided for inserting a generally tubular riser into a plurality of bores through a template which is secured to a casing positioned within a subterranean well bore. The method comprises positioning within such casing a generally tubular riser which is releasably secured to an orienting cam. The riser is automatically aligned with one of said plurality of bores through the template and is released from the cam. A portion of the riser is then inserted within one of the plurality of bores.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings:

FIG. 3 is a top view of one embodiment of the template of the present invention;

FIG. 4 is a perspective view of a riser utilized in conjunction with the template of the present invention;

DETAILED DESCRIPTION OF THE PREFERRED EMBODIMENTS

Figure 1:
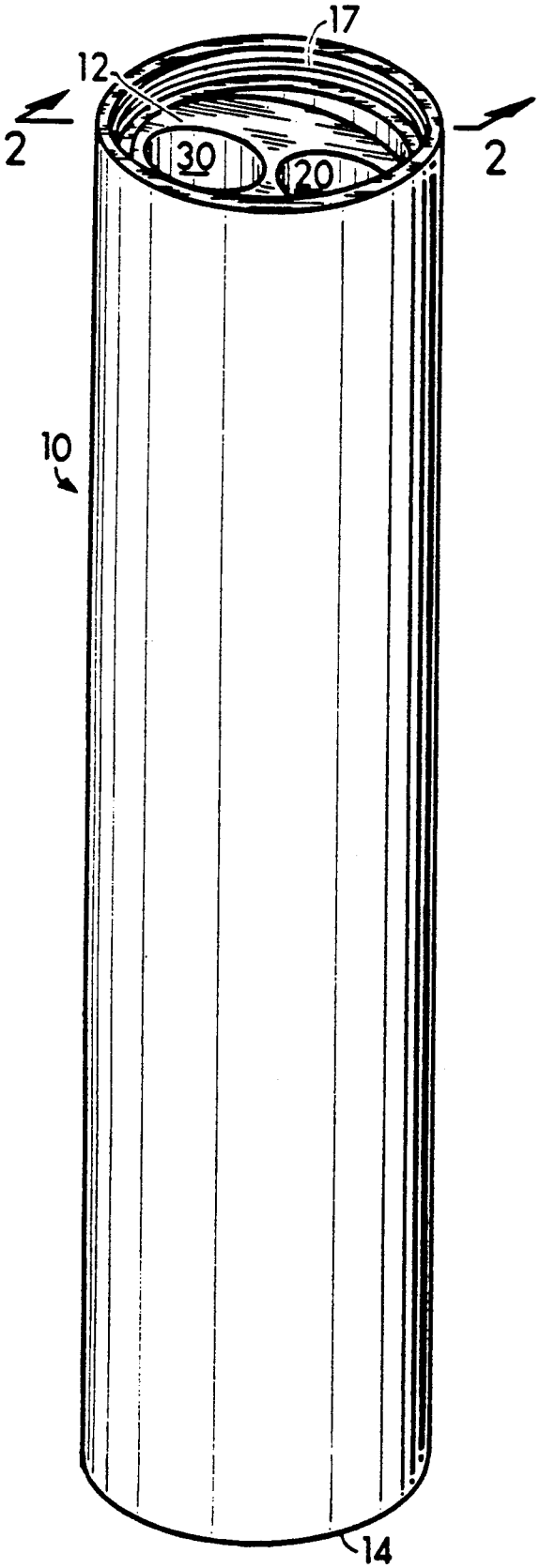
FIG. 1 is a perspective view of one embodiment of the template of the present invention.

Referring to FIG. 1, a multiple well template or guide is illustrated generally as 10 and has a generally cylindrical peripheral configuration to assist in being positioned within a cased well bore, as hereinafter described. Although illustrated as generally cylindrical, template 10 can have other peripheral configurations depending upon the construction thereof as will be evident to a skilled artisan. Template 10 has two end faces 12, 14 and two generally cylindrical bores 20, 30 therethrough. Each of bores 20, 30 intersects both end faces 12, 14 of template 10. Preferably, substantially the entire diameter of each bore 20 and 30 intersects both end faces 12 and 14. Although each end face 12, 14 is illustrated in FIG. 1 as being generally planar, it will be evident to a skilled artisan that end faces 12 and/or 14 can be non-planar, such as concave or trough shaped, without departing from the scope of the present invention. End face 12 is inclined to facilitate insertion of a riser and casing into bore 20 for drilling and completion purposes in a manner as will be hereinafter described. Preferably, end face 12 is provided with receptacle(s) 19 (FIG. 3) to assist in providing an indication to a surface operator that riser 40 has been inserted into bore 30 in a manner as hereinafter described. One end of template 10 has a collar portion 16 which is provided with internal screw threads 17.

Figure 2:
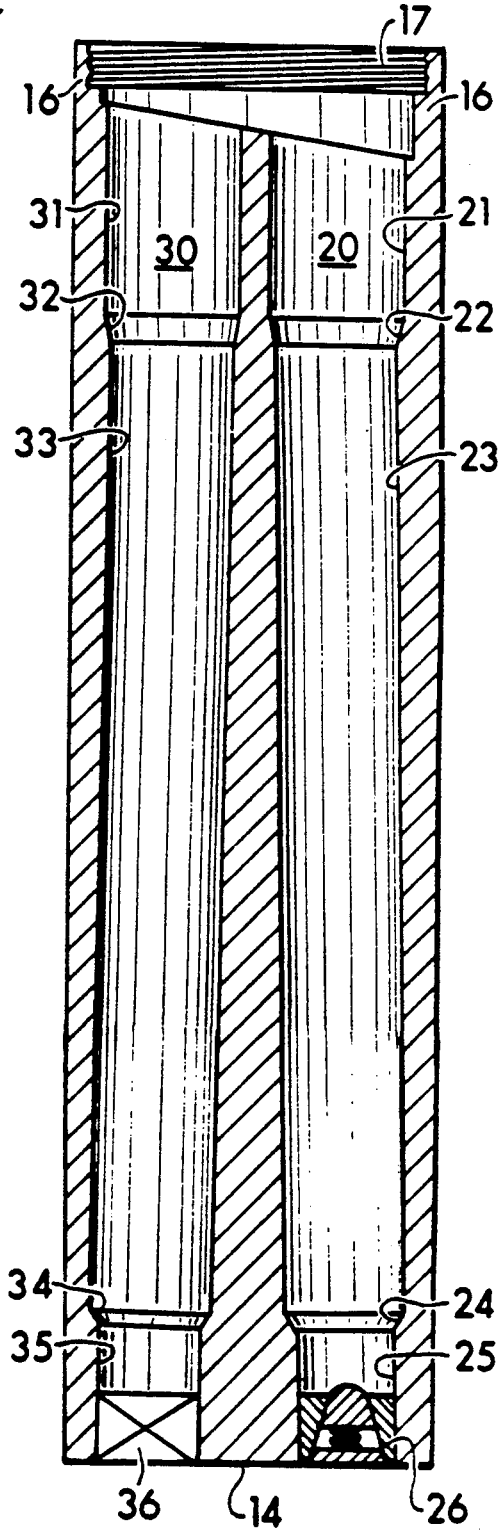
FIG. 2 is a sectional view of one embodiment of the template of the present invention taken along the line 2—2 of FIG. 1.

As illustrated in FIG. 2, bores 20 and 30 extend and are offset along the entire axial length of template 10. Bores 20 and 30 are each provided with first sections 21, 31, second sections 23, 33 and third sections 25, 35, respectively. The first and second sections of bores 20, 30 define annular shoulders 22, 32 therebetween while the second and third sections of bores 20, 30 define annular shoulders 24, 34 therebetween. Bores 20, 30 are arranged so as to diverge from each other from end face 12 toward end face 14 (FIGS. 2 and 3). Such divergence usually should not exceed 2° over the entire length of template 10, and preferably is less than 1°. A one way valve 26, such as a spring loaded float valve, is secured within third section 25 by any suitable means, such as by welds, while a plug 36 is secured within third section 35 to provide a fluid tight seal in bore 30.

Template 10 may be unitary or constructed of multiple sections which are secured together by any suitable means, such as screw threads, cam locks, and welds, and are sealed together by, for example, O-rings. Template 10 is preferably constructed from a suitable metal or combinations of metals, which are chosen based upon the loads and pressures to be encountered in the casing during use. Generally, template 10 has a length of from about 15 feet to about 60 feet or more.

A conventional riser 40 is illustrated in FIG. 4 as having a plurality of annular seals 42, such as O-rings, positioned about the exterior surface near one end thereof so as to define a seal portion 41. A collar 43 is secured to riser 40 adjacent seal portion 41 to aid in positioning seal section 41 within bores 20 and 30 as hereinafter described. Preferably, the lower surface of collar 43 is provided with protuberance(s) (not illustrated) which correspond in number to receptacle(s) 19 on end face 12. Further, the edge of collar 43 can be provided with a slot of varying width and surface or intermediate casing 50 can be provided with a key or dog as will be evident to a skilled artisan such that engagement of the key or dog by such slot will assist in orienting riser 40 for insertion into either bore 20 or 30.

Figure 5B:
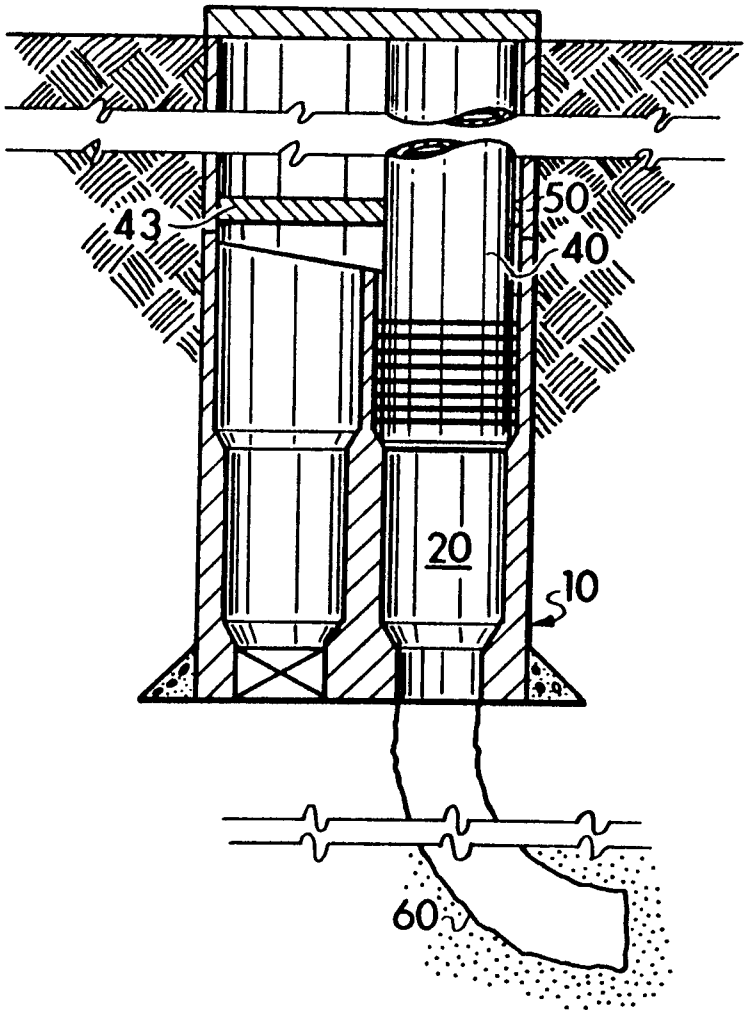
FIGS. 5A–5I are partially cutaway, schematic views of the template of the present invention as utilized to drill and complete multiple subterranean wells.
Figure 5A:
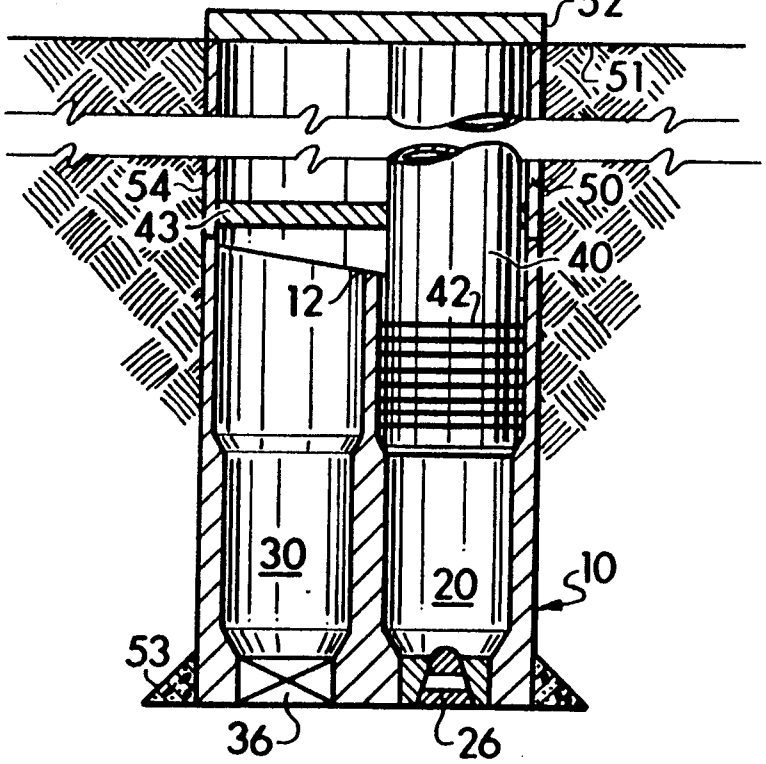

In operation, template 10 is secured to the bottom of surface or intermediate casing 50 by means of screw threads 17 on collar portion 16. As illustrated in FIG. 5A, surface or intermediate casing 50 with template 10 secured to the bottom thereof is positioned within a well bore 54 and anchored therein in a conventional manner by means of cement 53. Well bore 54 can be generally vertical or deviated. Surface or intermediate casing 50 extends to the surface of the earth 51 thereby defining a well head 52. In accordance with the present invention, tubular riser 40 is lowered within surface casing until seal portion 41 (FIG. 4) is positioned within first section 21 of bore 20. The inclination of end face 12 of template 10 in conjunction with collar 43 function to guide seal portion 41 of riser 40 into bore 20. Once riser 40 is positioned within template 10, a fluid, such as drilling mud, is injected into riser 40 to ensure that the riser has entered bore 20. Should fluid pressure increase at the surface, such increase would indicate that riser 40 is positioned within bore 30 containing plug 36 and riser 40 would be withdrawn from template 10 and repositioned within bore 20.

Figure 5D:
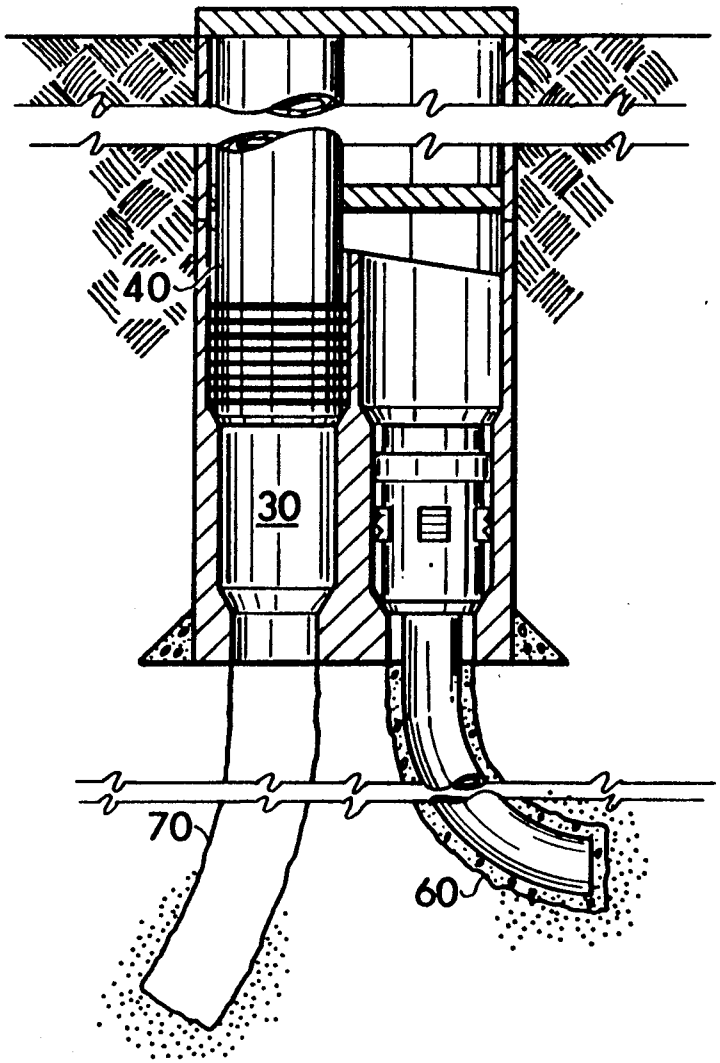
Figure 5C:
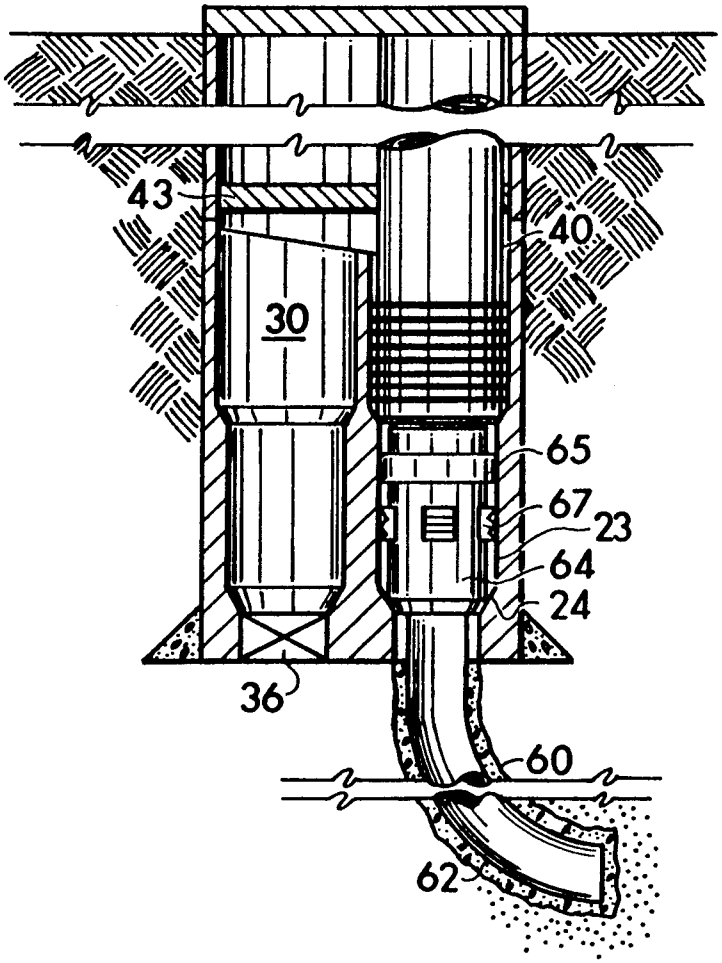

Once riser 40 is properly positioned within bore 20, casing 50 is cemented within well bore 54 by conventional techniques. A conventional drill string including a drill bit and mud motor (not illustrated) is transported within riser 40 into bore 20 of template 10 whereupon valve 26 and cement, if any, is drilled out of bore 20. Thereafter, a first well bore 60 is drilled by the drill string in a conventional manner as will be evident to the skilled artisan with drilling mud and formation cuttings being circulated out of well bore 60 to surface 51 via riser 40. Although illustrated in FIG. 5B as deviated, first well bore 60 can also be drilled in a generally vertical orientation. Thereafter, the drill string is withdrawn from riser 40 and casing 62 is lowered through riser 40 and is secured to template 10, and thus surface or intermediate casing 50, by means of conventional liner hanger 64. In a preferred embodiment, liner hanger 64 is seated upon and is supported by annular shoulder 24 (FIG. 5C). Liner hanger 64 includes an expandable packer 65 to seal the annulus between the liner hanger and bore 20 and expandable slips 67 to assist in securing hanger 64 within second section 23 of bore 20. Depending upon the total load supported by annular shoulder 24, slips 67 may not be needed to assist in supporting such load. Casing 62 can be cemented within first well bore 60. Riser 40 is then withdrawn from bore 20, rotated, and inserted into bore 30 of template 10. Preferably, end face 12 is provided with receptacle(s) 19 (FIG. 3) and the lower surface of collar 43 with corresponding protuberance(s) (not illustrated) which mate with receptacle(s) 19 to provide an indication to the surface operator that riser 40 has been inserted into the bore which is equipped with a plug 36 (as illustrated, bore 30). A drill string is then transported via riser 40 into bore 30 and plug 36 is drilled out. The drill string is passed through bore 30 and a second well bore 70 is drilled. Although illustrated in FIG. 5D as deviated, second well bore 70 can also be drilled in a generally vertical orientation, usually if first well bore 60 was deviated. Thereafter, the drill string is withdrawn from riser 40 and casing 72 is lowered through riser 40 and is secured to template 10, and thus surface or intermediate casing 50, by means of conventional liner hanger 74 (including expandable packer 75 and slips 77). Liner hanger 74 is seated upon and supported by annular shoulder 34 while packer 75 is expanded to seal the annulus between the liner hanger and bore 30 and slips 77 can be expanded when necessary to assist in securing hanger 74 within second section 33 of bore 30 (FIG. 5E). Casing 72 can be cemented within second well bore 70 as will be evident to the skilled artisan. The template of the present invention can be utilized during drilling of wells from onshore drilling rigs and/or offshore drilling platforms.

After first and second well bores 60, 70 have been drilled and cased, riser 40 is withdrawn from surface or intermediate casing 50 (FIG. 5F) and production casings 66, 76 are sequentially, sealingly secured to casings 62, 72 or bores 20, 30 respectively (FIGS. 5G and 5H) by means of seals secured to and positioned around the lower end of casings 66 and 76. Casings 66, 76 are secured and supported at well head 52 by a conventional split hanger system (not illustrated) and are separated into distinct casinghead connections or trees by a tubing spool (not illustrated) as will be evident to a skilled artisan. Thereafter, casings 62, 72 are placed in fluid communication with a hydrocarbon bearing subterranean formation by any suitable means, such as by perforations, and hydrocarbons can be produced from the formation to the surface via casings 62, 66 and/or casings 72, 76 (FIG. 5H). Depending upon the application, a conventional production tubing 68, 78 can be inserted into casings 62, 72 (FIG. 5I). A conventional packer 69, 79 may be utilized to seal the annulus between such production tubing and casing against fluid flow and permit hydrocarbons to be produced to the surface via the production tubing. As thus completed in accordance with the present invention, a remedial operation including, but not limited to work overs, recompletions, and side tracking, can be performed in one well while hydrocarbons are simultaneously produced from the other well. In addition, fluid can be injected into a subterranean formation via one well as hydrocarbons are being produced from the same or a different subterranean formation via the other well.

Figure 6:
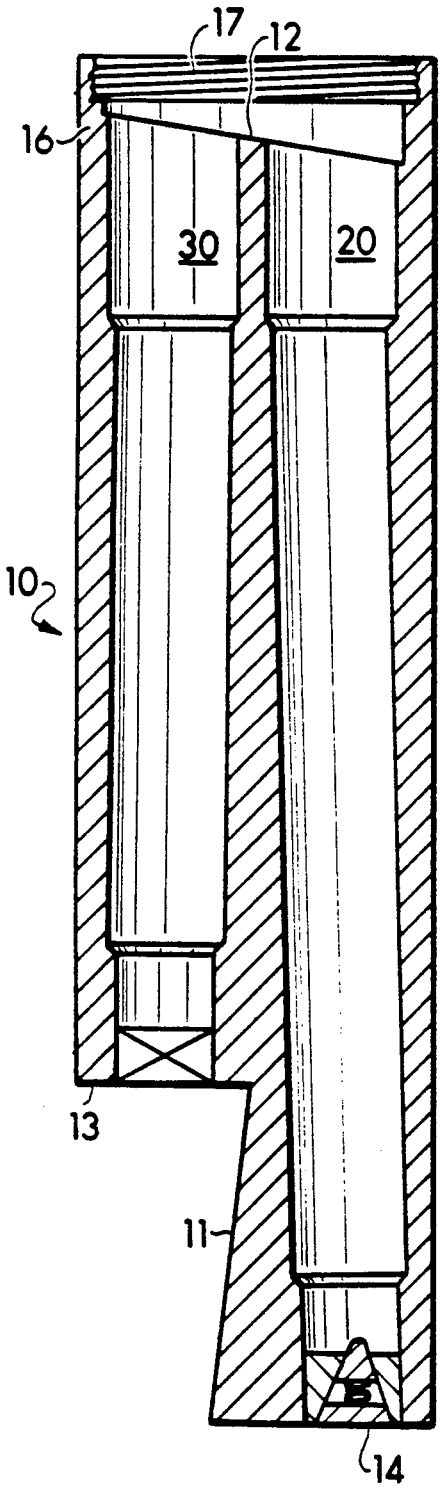
FIG. 6 is a sectional view of another embodiment of the template of the present invention.
Figure 7:
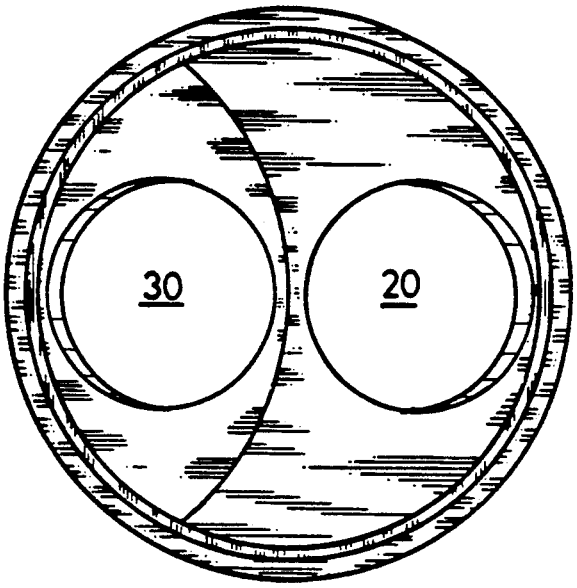
FIG. 7 is a bottom view of the embodiment of the template of the present invention illustrated in FIG. 6.

Another embodiment of template 10 of the present invention which is illustrated in FIG. 6 still has an inclined, generally planar end face 12 and two generally cylindrical bores 20, 30 therethrough. However, the dimensions of planar end face 14 are reduced and template 10 is formed with a separate end face 13 which bore 30 intersects. Surface 11 is defined between end faces 13, 14 and functions to guide drill string and casing which is inserted through bore 30 away from end face 14 and thus first well bore 60. Although a specific peripheral configuration of end faces 13, 14 is illustrated in FIG. 7, it will be evident to a skilled artisan that other peripheral configurations which assist in minimizing interference between drill strings and casing emanating from bores 20, 30 will be suitable for use in the present invention. In this embodiment, bore 30 has been shortened so as to provide a portion of subterranean formation between end faces 13, 14 within which the drill string emanating from bore 30 may be deviated so as to further minimize the possibility of interference between well bores which are drilled and completed in accordance with the present invention.

Figure 8:
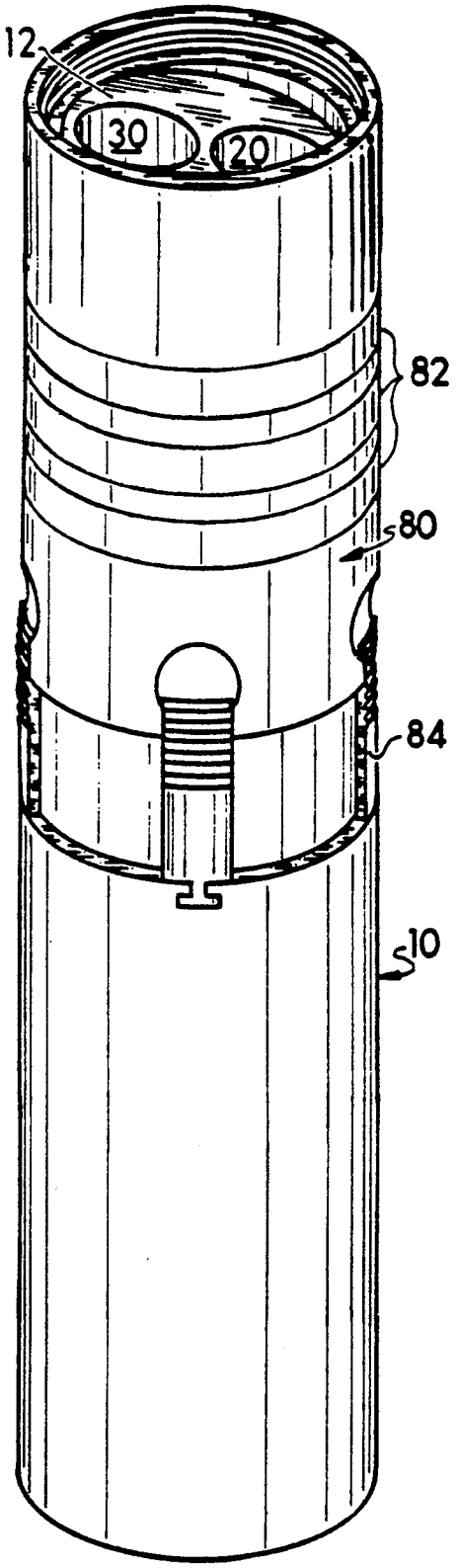
FIG. 8 is a perspective view of still another embodiment of the template of the present invention.

As illustrated in FIG. 8, template 10 can be equipped with a conventional packer assembly 80 which is positioned about and secured to the periphery of assembly 80, preferably at the upper end of template 10 as positioned within well bore 54. Packer assembly 80 comprises a plurality of expandable, annular elastomeric elements 82 and a plurality of slip elements 84. In this embodiment, template 10 is sized to be received within a casing, and thus, can be lowered by means of a drill string, tubing string, or wireline (not illustrated) within surface or intermediate casing 50 which has been previously cemented within a well bore 54. Once positioned near the lowermost end of casing 50, slips 84 and elements 82 are sequentially expanded into engagement with surface or intermediate casing 50 in a manner and by conventional means as will be evident to a skilled artisan so as to secure template 10 within surface or intermediate casing 50 and seal the annulus therebetween. Slips 84 are sized and configured to support not only template 10, but also production casings 62, 66, 72, and 76.

Figure 9:
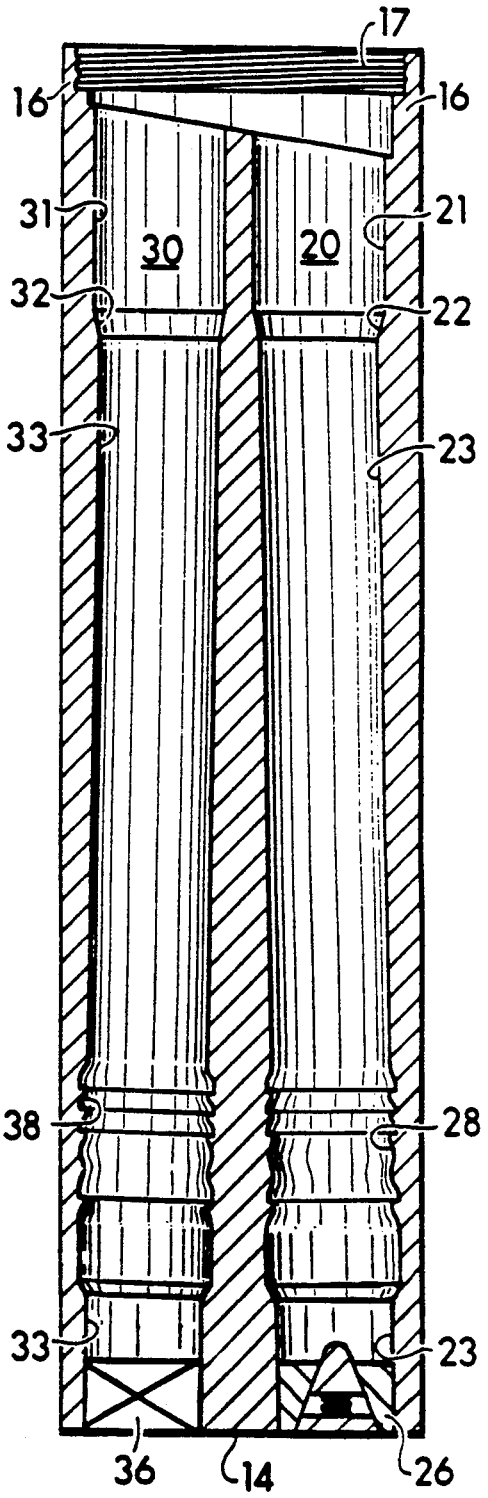
FIG. 9 is a sectional view of another embodiment of the template of the present invention.

An alternative embodiment of template 10 of the present invention is illustrated in FIG. 9 wherein each second section 23, 33 of bores 20, 30, respectively, is provided with a suitable profile 28, 38 into which the slips of a liner hanger can be expanded into engagement with. In this embodiment, slips 67, 77 of liner hangers 64, 74 will biased outwardly, for example by springs (not illustrated). In this manner, slips 67, 77 will be automatically expanded into engagement with profiles 28, 38, respectively, as liner hangers 64, 74 are lowered through bores 20, 30. The engagement of slips 67, 77 within profiles 28, 38 will be sufficient to support the liner hangers and the production casings that depend therefrom. In this embodiment, bores 20, 30 will not be provided with third sections 25, 35 thereby increasing the diameters of well bores 60 and 70 which can be drilled utilizing template 10. It will also be evident to a skilled artisan that liner profiles other than the profiles illustrated in FIG. 9 can be utilized in the practice of the present invention.

Figure 10:
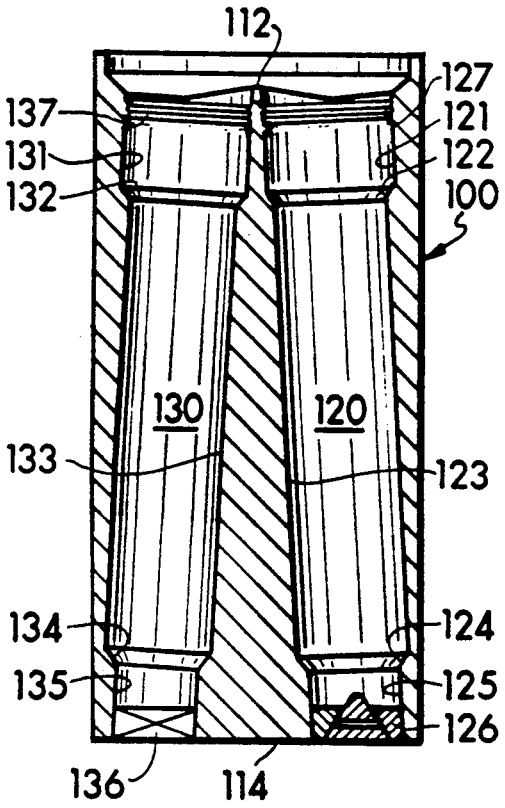
FIG. 10 is a sectional view of the preferred embodiment of the template of the present invention.
Figure 12:
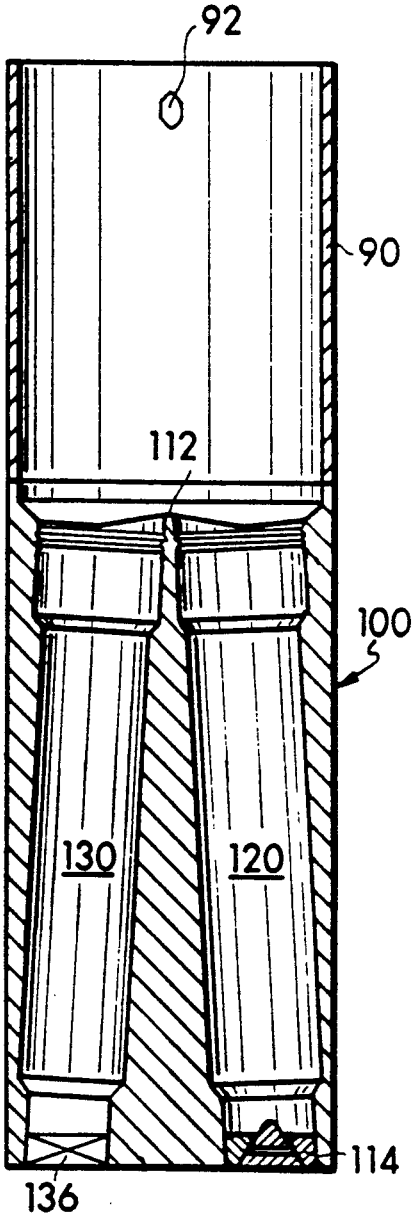
FIG. 12 is another sectional view of the preferred embodiment of the template of the present invention.
Figure 11:
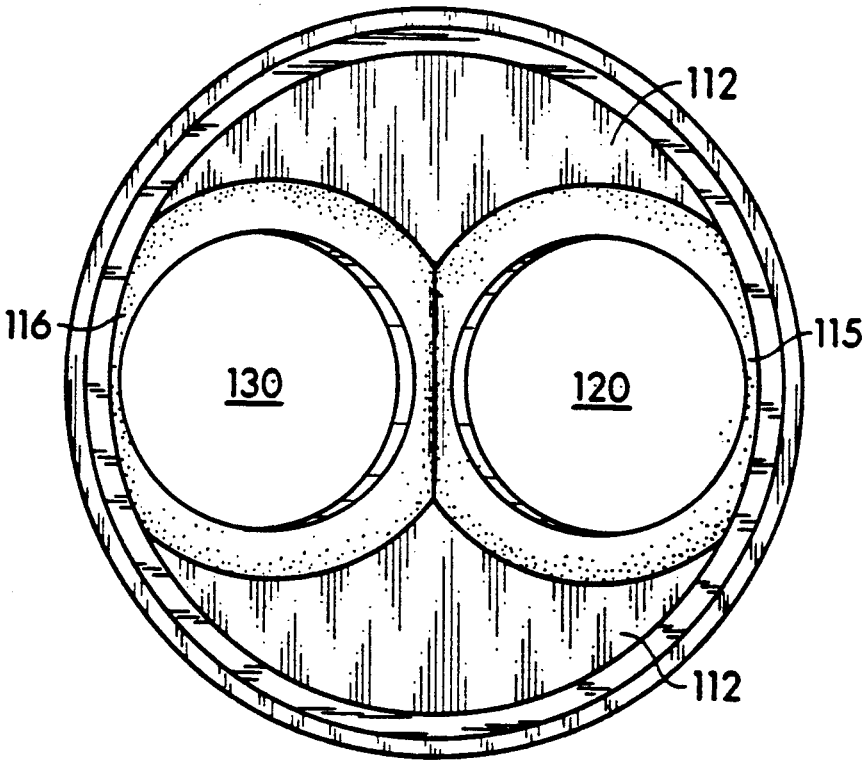
FIG. 11 is a top view of the template of the present invention as illustrated in FIG. 10.

A preferred embodiment of the template of the present invention is illustrated generally as 100 in FIGS. 10 and 12 and has two end faces 112, 114 and two bores 120, 130 therethrough. End face 112 is formed with concave indentations 115, 116 surrounding the intersection of bores 120, 130, respectively, with end face 112. Bores 120 and 130 extend and are offset along the entire axial length of template 100. Bores 120 and 130 are each provided with first sections 121, 131, second sections 123, 133, and third sections 125, 135, respectively. The first and second sections of bores 120, 130 define annular shoulders 122, 132 therebetween while the second and third sections of bores 120, 130 define annular shoulders 124, 134 therebetween. First sections of bores 120, 130 are provided with threaded sections 127, 137, respectively, for reasons hereinafter described. As illustrated, bores 120, 130 are arranged so as to diverge from each other from end face 112 toward end face 114 (FIG. 11). Such divergence usually should not exceed 2° over the entire length of template 100, and preferably is less than 1°. A one way valve 126, such as a spring loaded float valve, is secured within third section 125 by any suitable means, such as by welds, while a plug 136 is secured within third section 135 to provide a fluid tight seal in bore 130. As previously mentioned, template 100 may be unitary or constructed of multiple sections which are secured together by any suitable means, such as screw threads, cam locks, and welds, and are sealed together by, for example, O-rings. Template 100 is preferably constructed from a suitable metal or combinations of metals, which are chosen based upon the loads and pressures to be encountered in the casing during use.

As illustrated in FIG. 12, template 100 is preferably secured to a section of conductor, surface, or intermediate casing 90 by any suitable means, such as by threads or welds. Casing 90 is provided with an inwardly extending dog or key 92.

Figure 14:
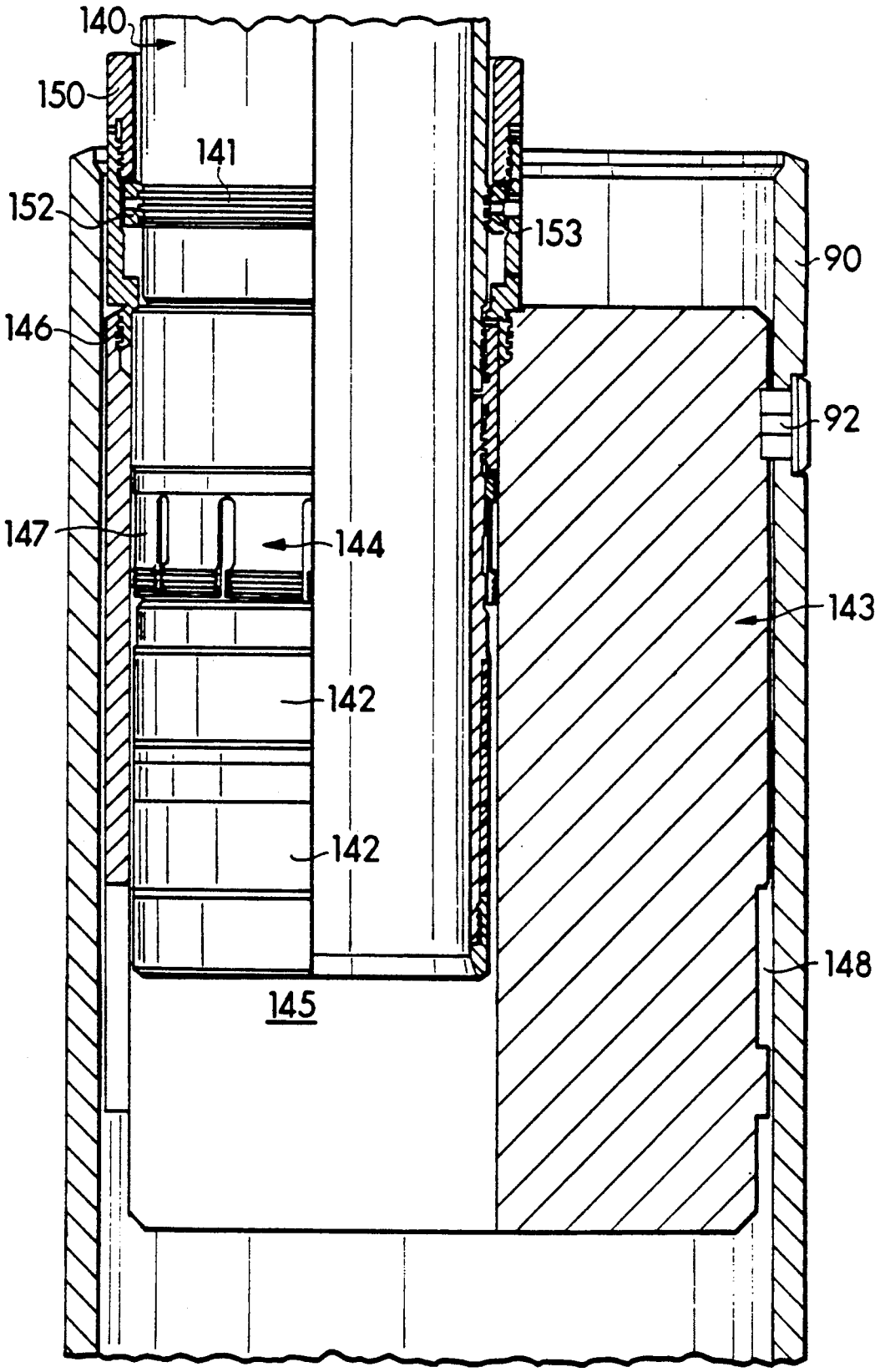
FIG. 14 is a partially cutaway, perspective view of the preferred riser illustrated in FIG. 13.

An orienting cam 143 is provided with an axially offset bore 145 therethrough (FIG. 14) which in turn is provided with threads 146 near the upper end thereof to which a generally tubular housing 150 is releasably secured. Housing 150 is provided with an expandable lock ring 152 having a threaded internal diameter 153 and positioned within a circumferentially extending groove in bore 145. Lock ring 152 is split in a manner evident to a skilled artisan to permit expansion when an article of sufficient diameter is inserted through the ring. Threads 141 and/or threaded internal diameter 153 can be tapered to permit their full engagement. A riser 140 is illustrated as having a plurality of annular seals 142, for example moly glass seal rings such as manufactured by Baker Oil Tools, and a collet 144 having a plurality of fingers 147. Each finger is biased outwardly and a corresponding portion of the external surface of each finger is threaded. Above collet 144, the external surface of riser 140 is provided with threads 141. As cam 143 and riser 140 are assembled for entry into a well bore, threaded section 141 of riser 140 is engaged with the internal threads of lock ring 152.

Figure 13:
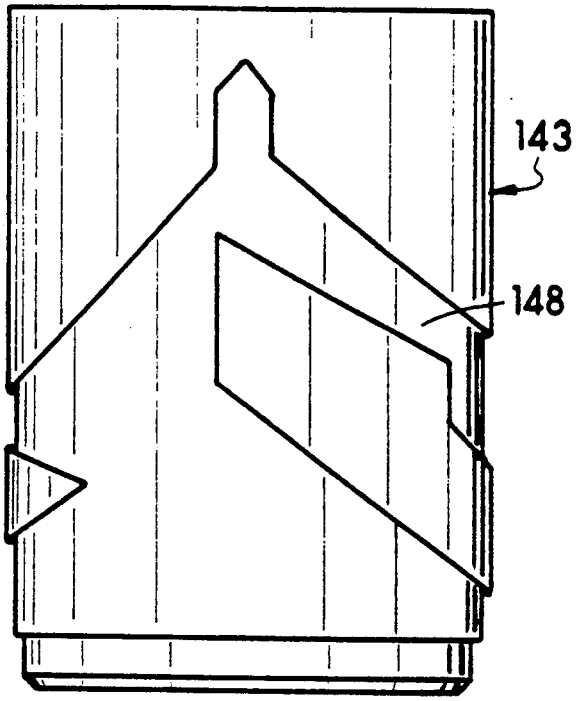
FIG. 13 is a perspective view of a preferred riser utilized in conjunction with the template of the present invention.
Figure 15:
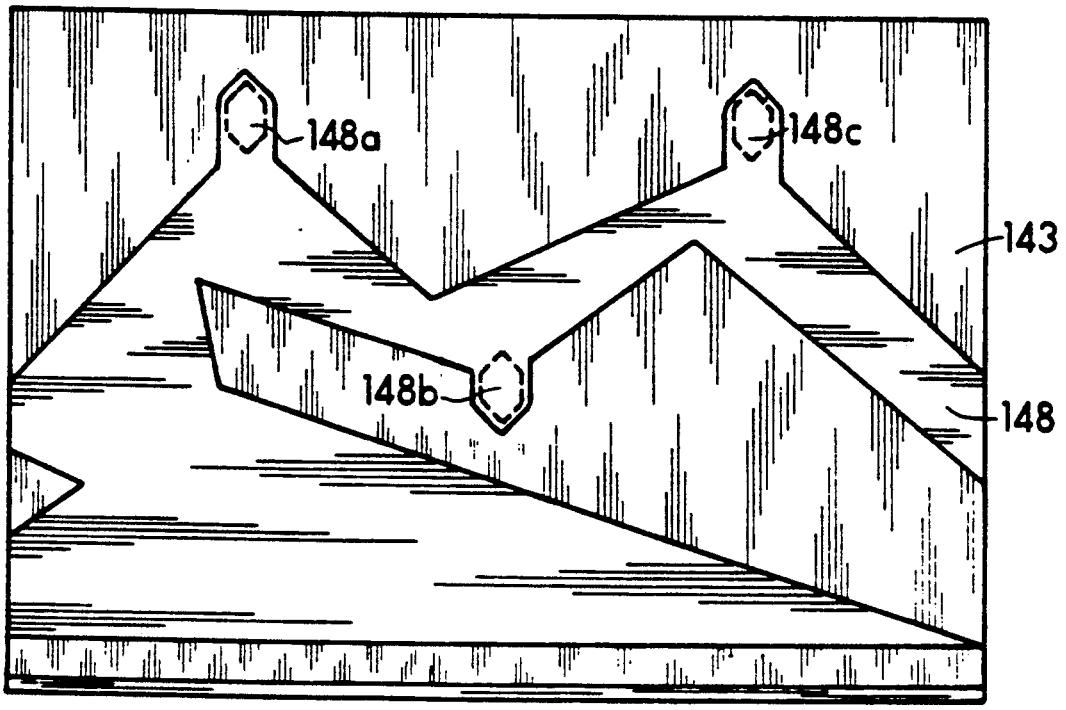
FIG. 15 is a 360° expanded view of the external surface of the preferred riser of the present invention.

As illustrated in FIGS. 13 and 15, the external surface of cam 143 is provided with a J-4 slot 148 which in conjunction with key 92 functions to orient riser 140 for insertion into either bore 120 or 130 in a manner hereinafter described.

In operation, template 100 is secured to the bottom of surface or intermediate casing 90 and positioned and cemented within a well bore 54 in a manner corresponding to that illustrated in FIG. 5A and previously described with respect to template 10. Riser 140 and orienting cam 143 are lowered within surface or intermediate casing 90 until key 92 contacts slot 148 in the external surface of cam 143. The inclined surfaces of slot 148 will cause cam 143 and riser 140 to rotate until key 92 assumes position **148*a* as illustrated in FIG. 15. As thus oriented, riser 140 will be aligned with bore 120. Rotation of riser 140 from the surface will cause the threaded external surface 141 riser 140 to disengage from threaded internal diameter 153 of expandable lock ring 152. Riser 140 is then lowered into bore 120 of template 100 until collet fingers 147 engage threaded section 127 of bore 120. Once the collet fingers are engaged in the template, the riser is then secured to the well head in a manner as will be evident to a skilled artisan. Thereafter, a first well 60 is drilled and provided with casing 62 in a corresponding manner to that described above with respect to template 10 and illustrated in FIGS. 5B and 5C**.

Riser 140 is released from the wellhead, placed in tension, and rotated to disengage the threaded external surfaces of collet fingers 147 from threaded section 127 of bore 120 so as to permit riser 140 to be raised into cam 143 and secured by automatically engaging threaded external surface 141 of riser 140 with threaded internal diameter 153 of expandable lock ring 152. The riser is then raised from the surface and engagement of key 92 within slot 148 causes the riser and cam 143 to automatically rotate until key 92 to assumes position **148*b* within slot 148. Subsequent lowering of riser 140 causes the riser and cam to rotate until key 92 is positioned at 148*c* within slot 148. In this orientation, riser 140 will be aligned with bore 130. Rotation of riser 140 from the surface will cause the threaded external surface 141 of riser 140 to threadably disengage from threaded internal diameter 153 of expandable lock ring 152. Riser 140 is then lowered into bore 130 of template 100 until collet fingers 147 engage threaded section 137 of bore 130. Once the collet fingers are engaged in the template, the riser is then secured to the well head in a manner as will be evident to a skilled artisan. Thereafter, a second well 70 is drilled and provided with casing 72 in a manner corresponding to that described above with respect to template 10 and illustrated in FIGS. 5D and 5E. Riser 140 is released from the well head, placed in tension, and rotated to disengage the threaded external surfaces of collet fingers 147 from threaded section 137 of bore 130 so as to permit riser 140 to be raised into cam 143 and secured thereto by automatically engaging threaded external surface 141 of riser 140 with threaded internal diameter 153 of expandable lock ring 152. The riser is raised from the surface and engagement of key 92 within slot 148 causes key 92 to disengage from slot 148 and the riser 140 and orienting cam 143** are raised to the surface.

Figure 5F:
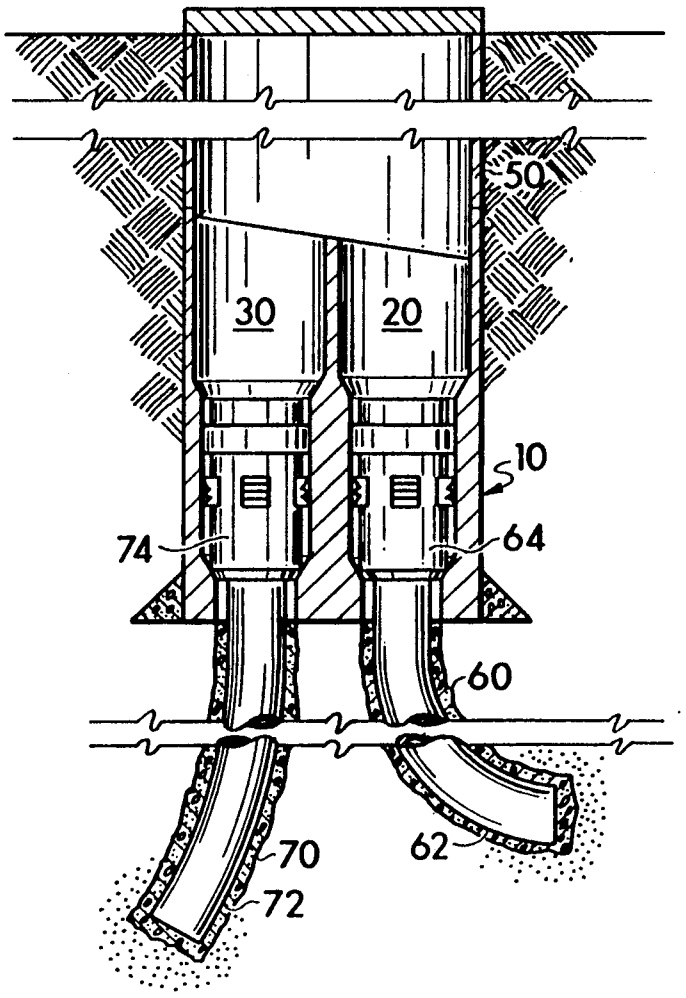
Figure 5E:
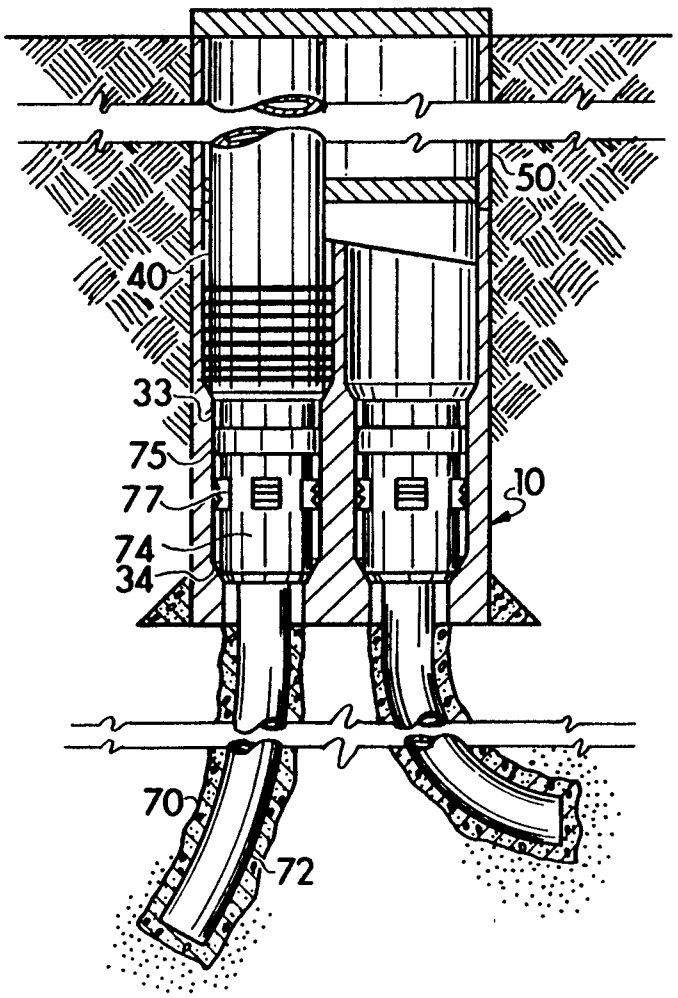
Figure 5H:
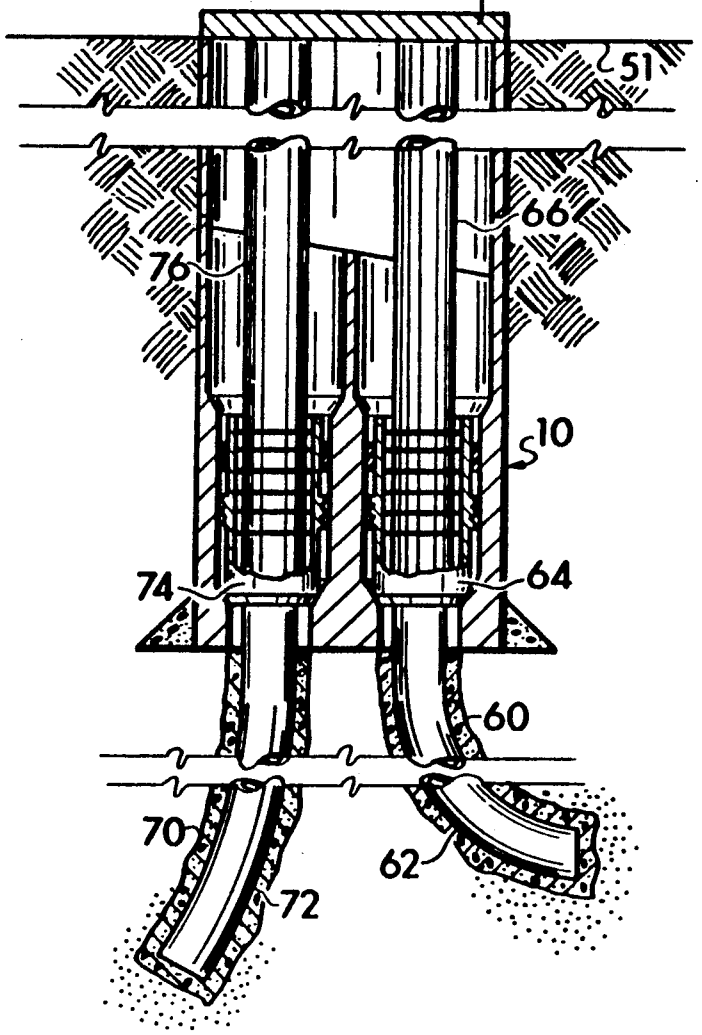
Figure 5G:
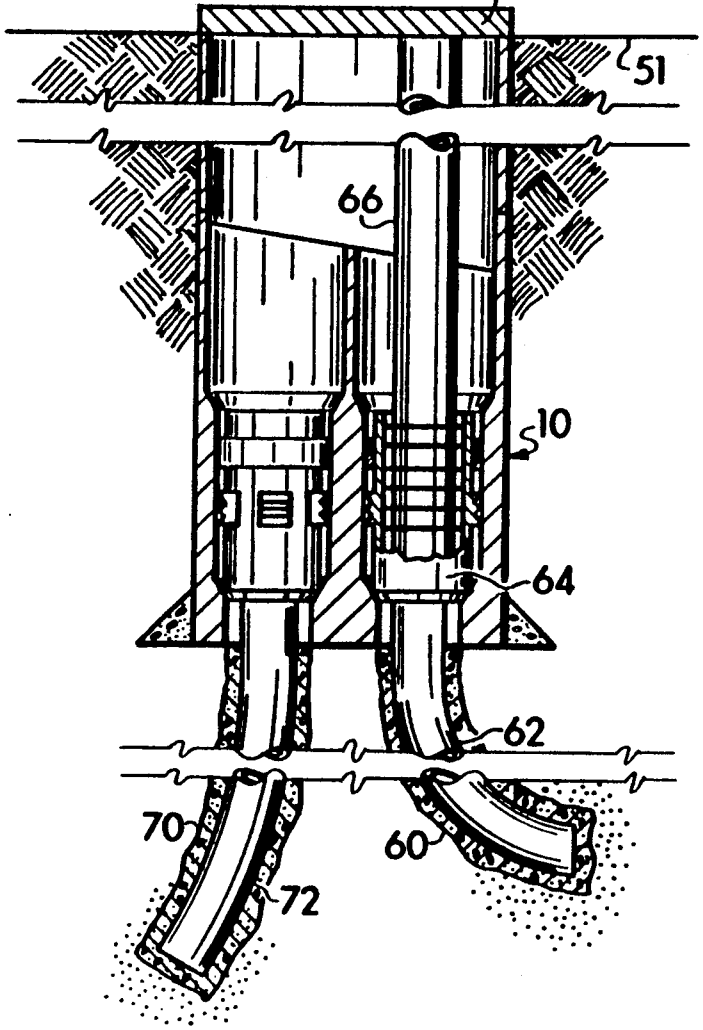
Figure 5I:
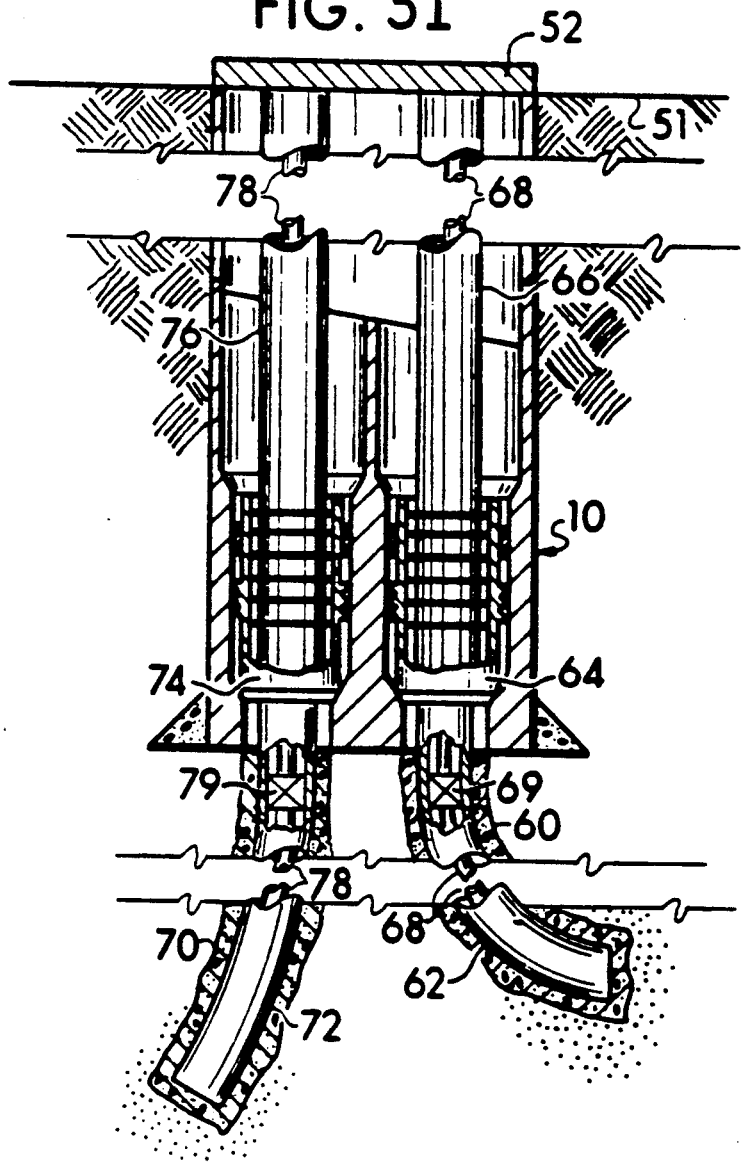

Production casings 66, 76 are thereafter secured to casings 62, 72 or bores 120, 130 respectively in a manner corresponding to that described above with respect to template 10 and illustrated in FIGS. 5F–5H. As previously discussed, casings 62, 72 are placed in fluid communication with a hydrocarbon bearing subterranean formation by any suitable means, such as by perforations, and hydrocarbons can be produced from the formation to the surface via casings 62, 72 and/or 72, 76 (FIG. 5H). Depending upon the application, a conventional production tubing 68, 78 can be inserted into casings 62, 72, a conventional packer 69, 79 may be utilized to seal the annulus between such production tubing and casing against fluid flow, and hydrocarbons can be produced to the surface via the production tubing. As thus completed in accordance with the present invention, a remedial operation including, but not limited to workovers, recompletions, and side tracking, can be performed in one well while hydrocarbons are simultaneously produced from the other well. In addition, fluid can be injected into a subterranean formation via one well as hydrocarbons are being produced from the same or a different subterranean formation via the other well.

Figure 16:
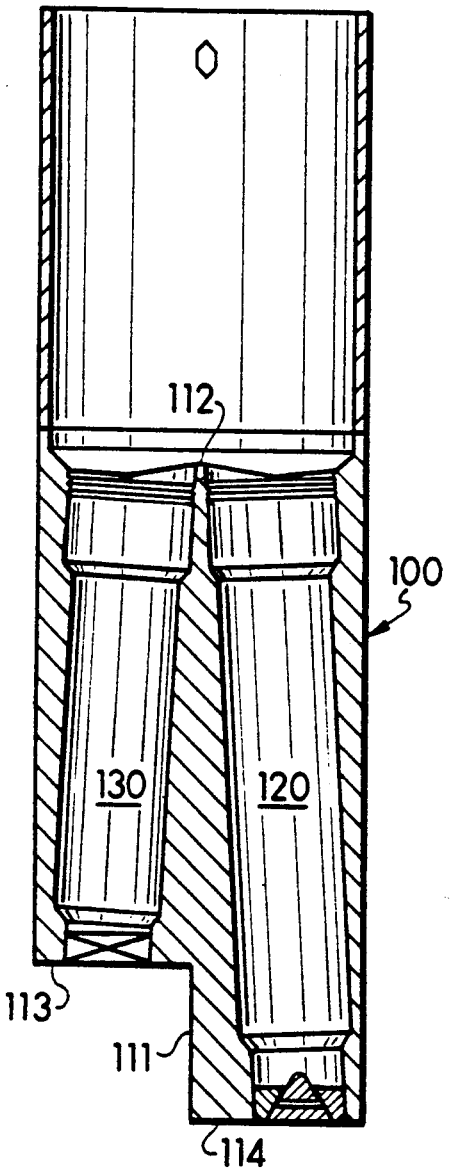
FIG. 16 is a another embodiment of the template of the present invention which is illustrated in FIG. 12.

As illustrated in FIG. 16, another embodiment of template 100 of the present invention has an end face 112 and two bores 120, 130 therethrough. The dimensions of end face 114 are reduced in this embodiment and template 100 is formed with a separate end face 113 which bore 130 intersects. Surface 111 is defined between end faces 113, 114 and functions to guide drill string and casing which is inserted through bore 130 away from end face 114 and thus first well bore 60. End faces 113 and 114 may be designed to have any peripheral configuration which will assist in minimizing interference between drill string and casing emanating from bores 120 and 130. In this embodiment, bore 130 has been shortened so as to provide a portion of subterranean formation between end faces 113 and 114 within which the drill string emanating from bore 130 may be deviated so as to further minimize the possibility of interference between well bores which are drilled and completed in accordance with the present invention.

Figure 17:
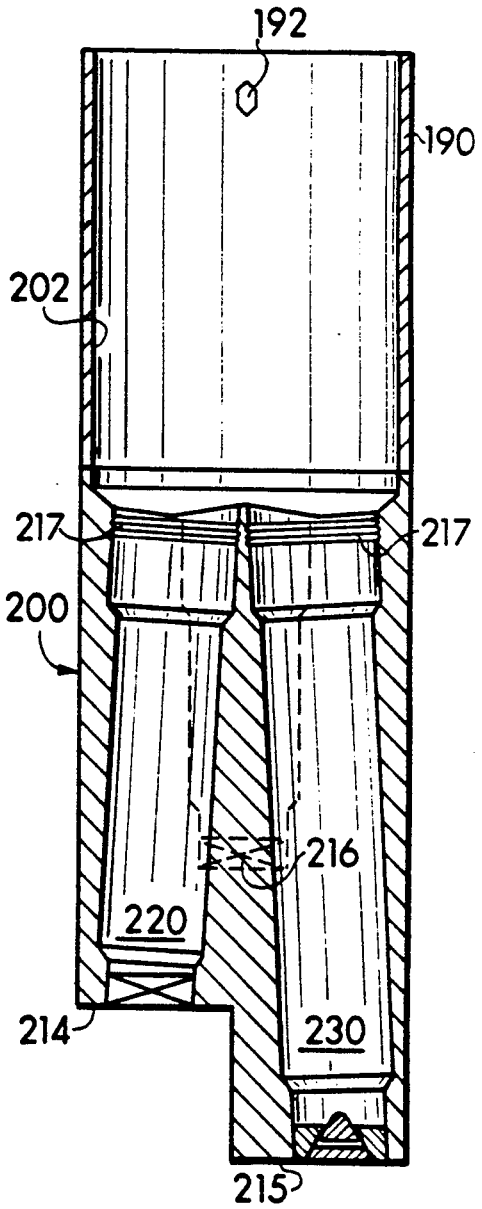
FIG. 17 is a sectional view of another embodiment of the template of the present invention having three axially extending bores therethrough.
Figure 18:
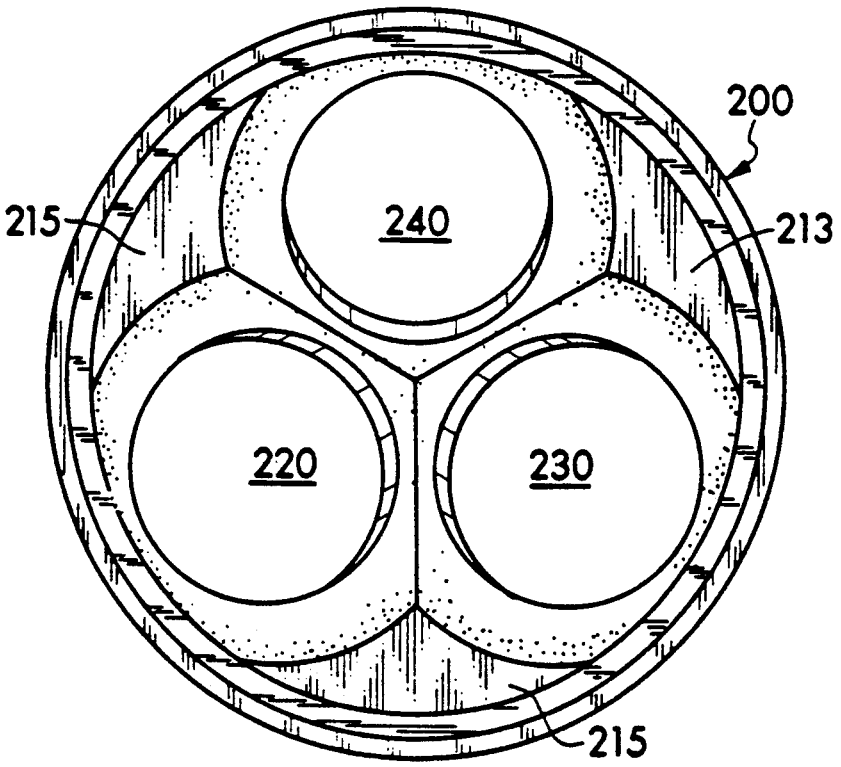
FIG. 18 is a top view of the template of the present invention which is of FIG. 17.

The template of the present invention can be provided with three or more bores depending upon the diameter of the bore into which the template is positioned and the diameter of the well bores to be drilled using the template. As illustrated in FIGS. 17 and 18, a template or guide is illustrated generally as 200 and has three generally cylindrical bores 220, 230 and 240 therethrough. End face 212 is provided with a plurality of inclined facets or scoops 215 to assist in positioning a riser or casing into bores 220, 230 and 240 during drilling and completion operations as previously described. Each bore 220, 230 and 240 is provided with screw threads 217 to releasably secure a riser or casing therein as previously discussed. Template 200 is secured to the bottom of conductor, surface or intermediate casing 190 by any suitable means, such as threads or welds. Casing 190 is provided with an inwardly extending key or dog 192 which is secured to casing 190, for example, by welds. Template 200 is provided with three separate end faces 214, 215 and 216 which are intersected by bores 220, 230 and 240, respectively and which may lie along substantially the same plane, as illustrated in FIG. 2, or may be formed at different intervals along the longitudinal length of template 200, as illustrated in FIG. 17. When positioned at different intervals, separate portions of subterranean formation are provided between end faces 214, 215 and 216 within which a drill string emanating from bores 220, 230 and 240, respectively, can be deviated to minimize the possibility of interference between well bores which are drilled and completed in accordance with the present invention. As illustrated in FIG. 17, each of bores 220, 230 and 240 may also diverge from each other from end face 212 toward end faces 214, 215 and 216 to further minimize the possibility of well interference. If arranged to diverge, the degree of such divergence usually should not exceed 2° over the entire length of template 200, and is preferably less than 1°. When three bores are provided through the embodiment of the template illustrated in FIG. 17, bore 230 which is equipped with a one-way valve will occupy a lowermost position with respect to inclined end face 12.

Figure 19:
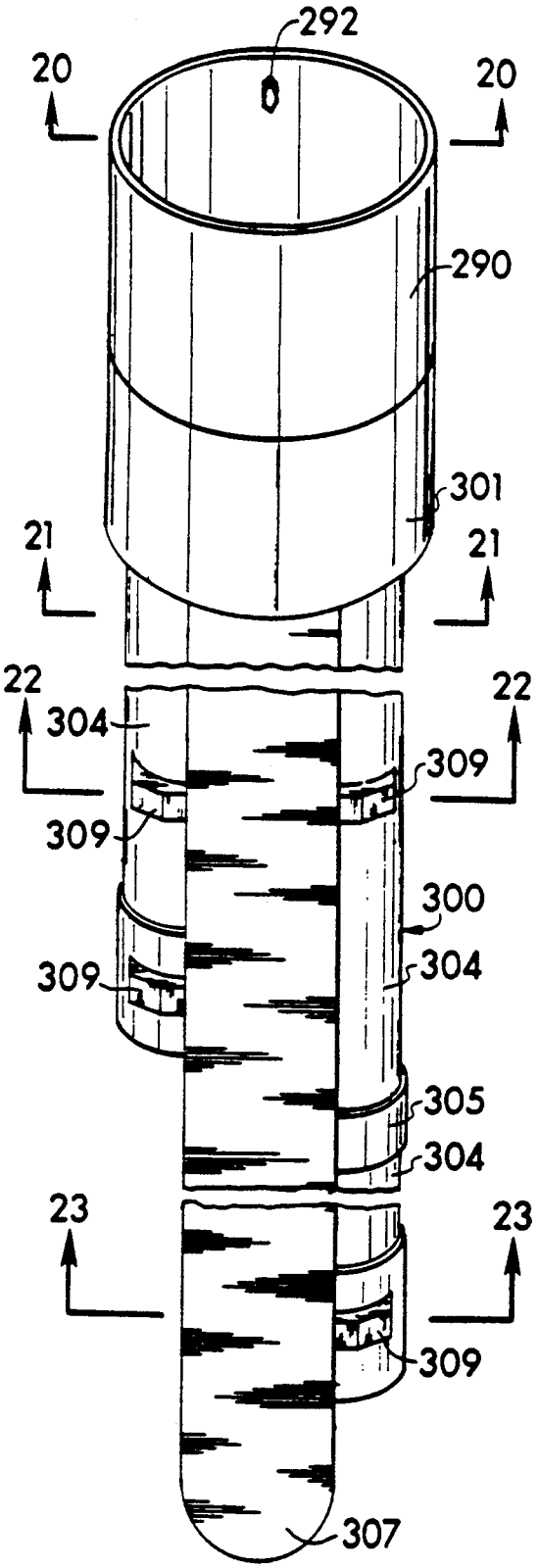
FIG. 19 is a perspective view of another embodiment of the template of the present invention.
Figure 20:
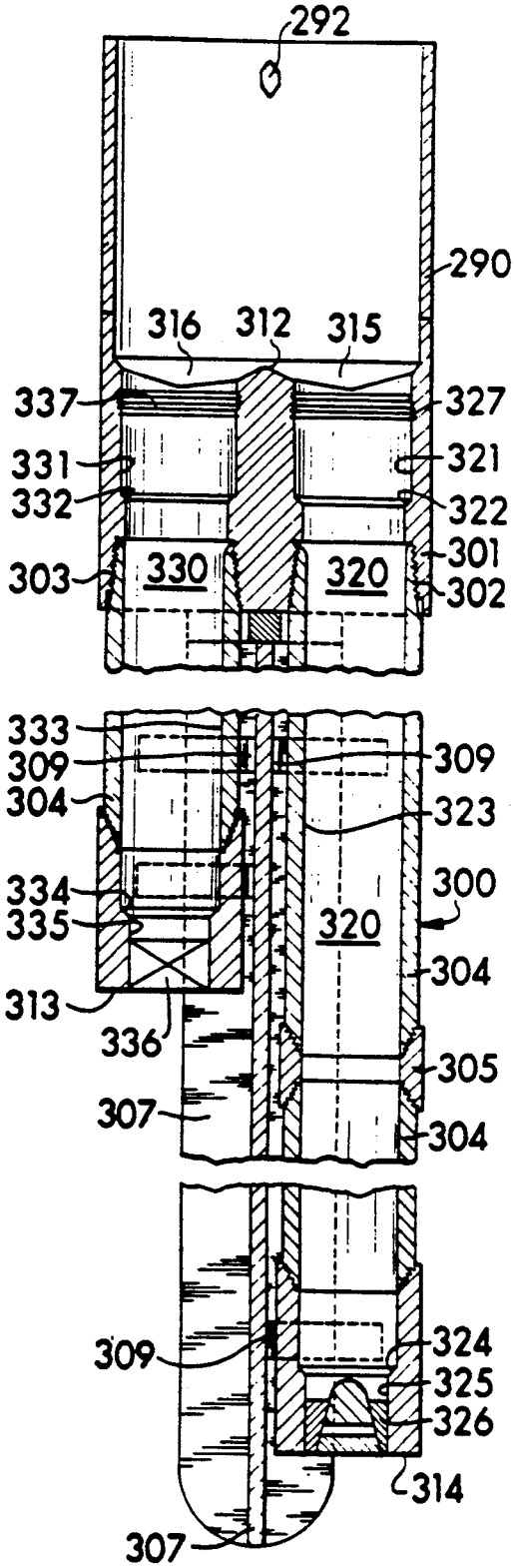
FIG. 20 is a cross sectional view taken along line 20—20 of FIG. 19.
Figure 21:
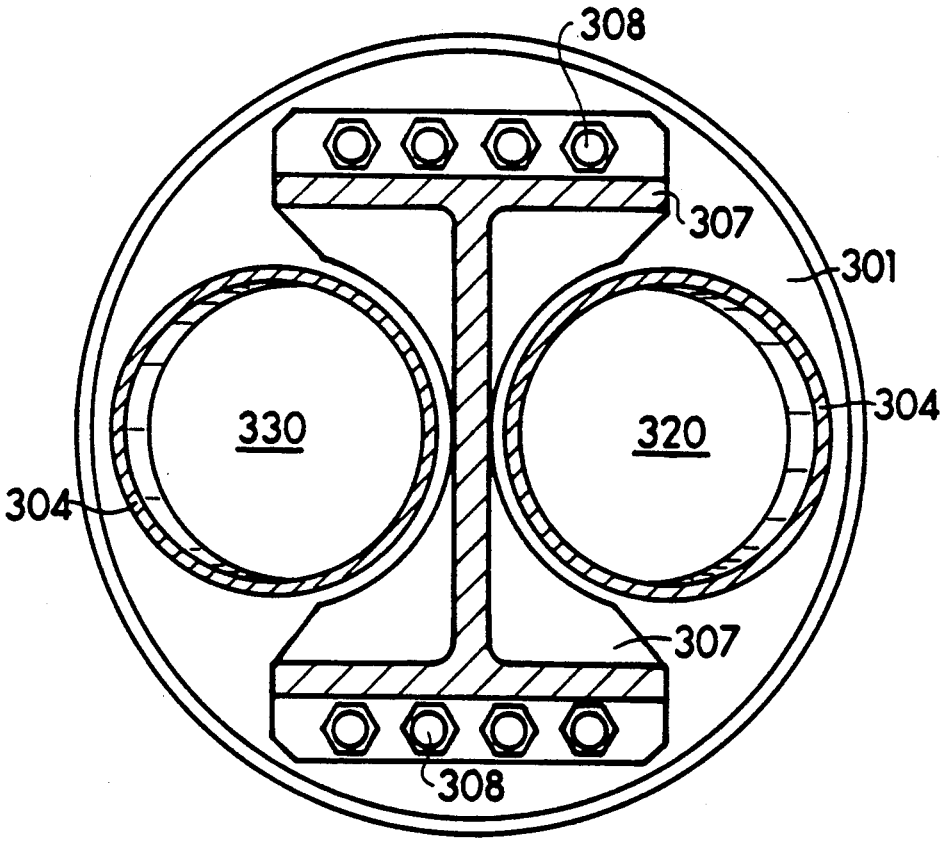
FIG. 21 is a cross sectional view taken along line 21—21 of FIG. 19.
Figure 22:
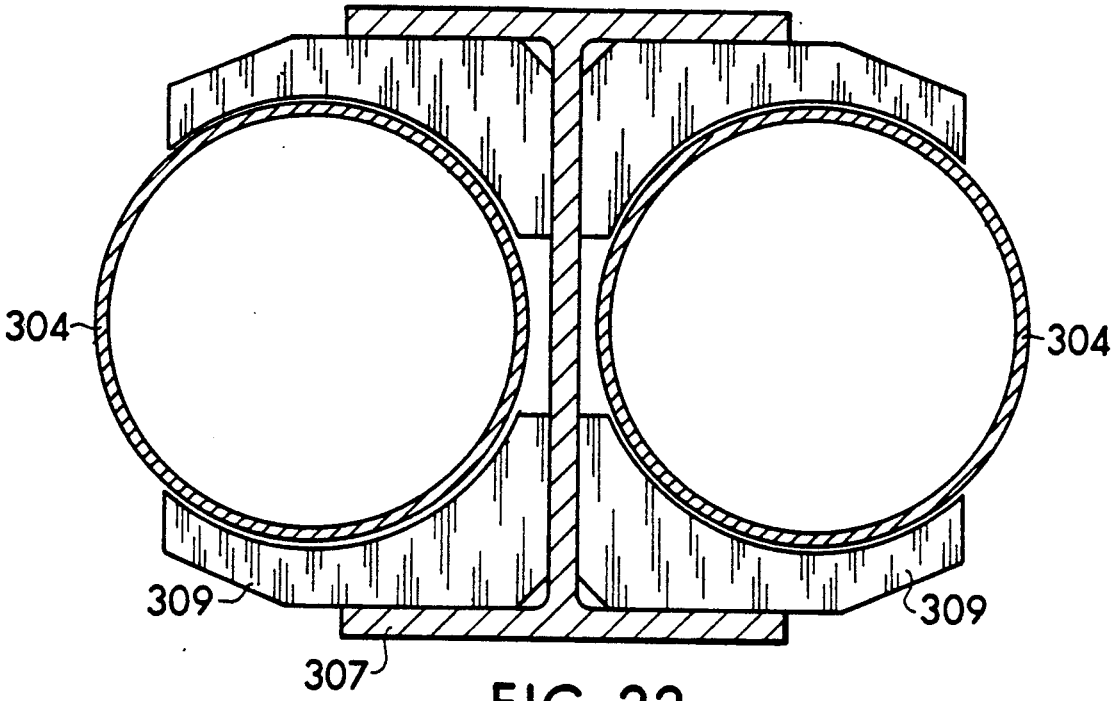
FIG. 22 is a cross sectional view taken along line 22—22 of FIG. 19.
Figure 23:
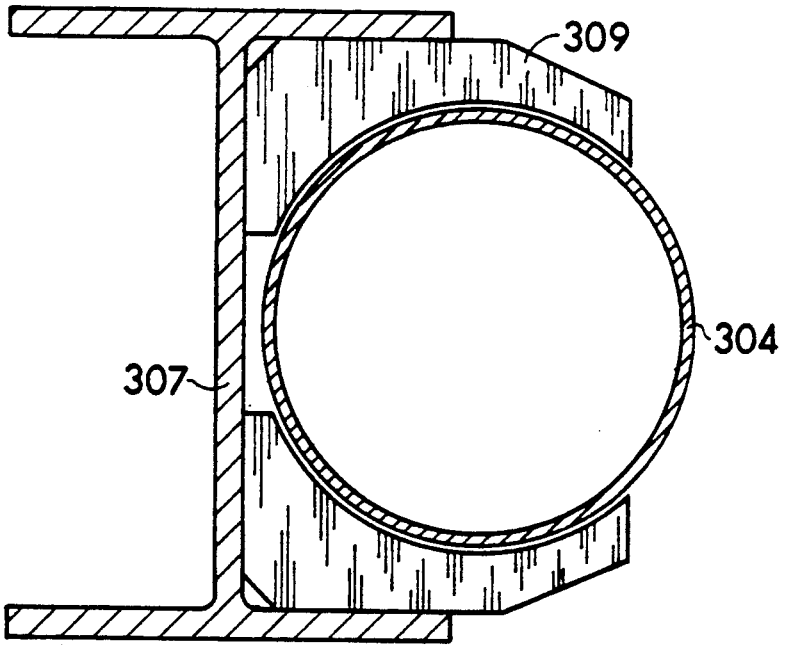
FIG. 23 is a cross sectional view taken along line 23—23 of FIG. 19.

As previously mentioned, the template of the present invention may be unitary or constructed of multiple sections. An example of a template of the present invention which is constructed of multiple sections is illustrated generally in FIGS. 19 and 20 as 300. Template 300 is comprised of a first upper section 301, an elongated frame 307, and a plurality of tubular members 304. First upper section 301 is provided with two bores therethrough having lower threaded sections 302. The end face 312 of first section 301 is formed with indentations 315, 316 surrounding the intersection of the two bores. An elongated frame, for example I-beam or H-beam 307, is secured to the other end face of first section 301 by any suitable means, such as bolts 308 (FIG. 21). Generally C-shaped guides 309 are secured to I-beam or H-beam 307 along the length thereof such as by welds. Tubular members 304 are positioned through guides 309 on each side of I-beam or H-beam 307 (FIGS. 22 and 23) and mated with threaded sections 302 of the bores through first section 301. Guides 309 function in combination with elongated frame 307 to restrain and inhibit movement of tubular member(s) 304 positioned through such guides. Different tubular members 304 positioned on the same side of I-beam or H-beam 307 are secured together by any suitable means, for example, threaded collar 305. The free end of each tubular member 304 is mated with a shoe 306 into which a float valve 326 is secured on one side of I-beam or H-beam 307 while a plug 336 is inserted into the other side of beam 307.

Figure 24:
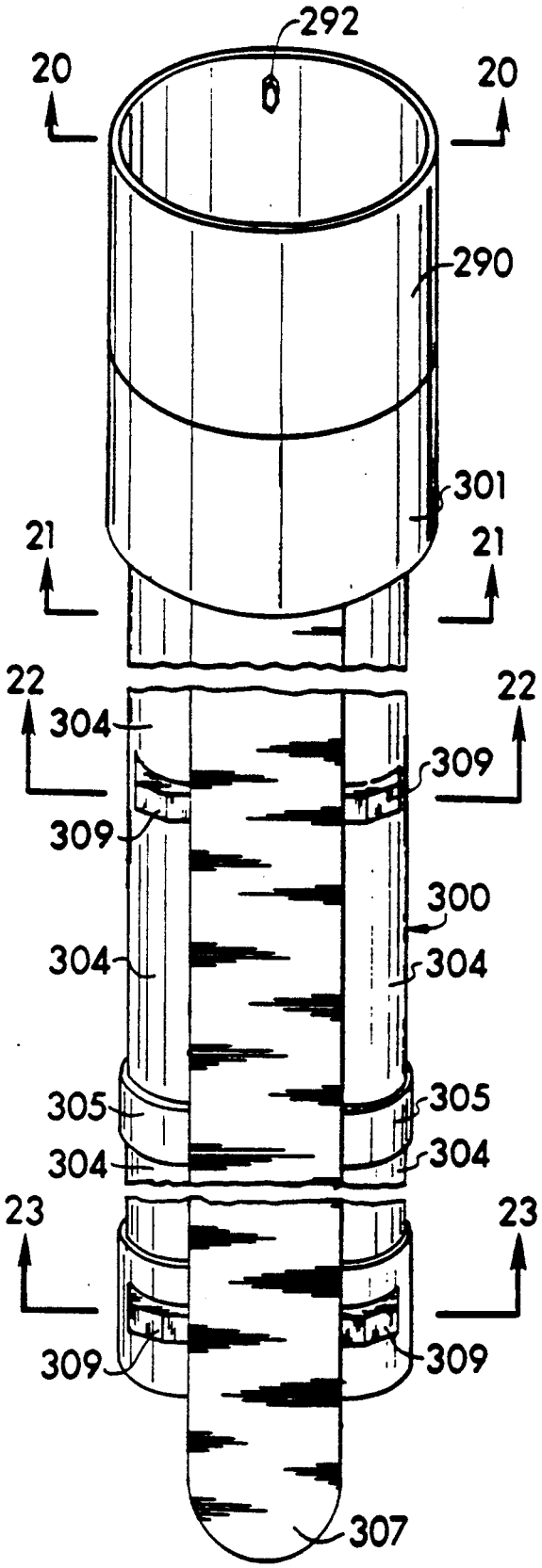
FIG. 24 is a perspective view of yet another embodiment of the template of the present invention.

As thus assembled, first section 301, beam 307 and tubular members 304 define a template 300 having two generally cylindrical bores 320, 330 therethrough. Examplary of the relative dimensions of template 300, the length of first section 301 may be 4 feet, of bore 330 measured from the bottom of first section 301 to end face 313 may be 30 feet, of bore 320 measured from the bottom of first section 301 to end face 314 may be 45 feet, and of intermediate or surface casing 290 may be 8 feet. As illustrated in FIG. 20, bores 320, 330 are each provided with first sections 321, 331, second sections 323, 333, and third sections 325, 335, respectively. The first and second sections of bores 320, 330 define annular shoulders 322, 332 therebetween while the second and third sections of bores 320, 330 define annular shoulders 324, 334 therebetween. Bores 320, 330 may be arranged so as to diverge from each other from end face 312 toward end faces 314, 313, respectively. If arranged to diverge, the degree of such divergence usually should not exceed 2° over the entire length of template 300, and is preferably less than 1°. In the embodiment illustrated in FIGS. 19, 20, bore 330 is shorter than bore 320 to provide a portion of subterranean formation between end faces 313 and 314 within which the drill string emanating from bore 330 may be deviated so as to minimize the possibility of interference between well bores which are drilled and completed in accordance with the present invention. As illustrated in FIG. 24, bores 320 and 330 may also be substantially identical in length. In either embodiment, one or both sides of I-beam 307 may be provided with a whipstock(s) secured thereto below bore(s) 320 and/or 330 by any suitable means, such as welds, to further assist in minimizing interference between the well bores drilled utilizing template 300 of the present invention.

In operation, template 300 is secured to the bottom of surface or intermediate casing 290 and positioned and cemented within a well bore 54 in a manner corresponding to that illustrated in FIG. 5A and previously described with respect to template 10. Riser 140 and orienting cam 143 are lowered within surface or intermediate casing 290 until key 292 contacts slot 148 in the external surface of cam 143. The inclined surfaces of slot 148 will cause cam 143 and riser 140 to rotate until key 292 assumes position 148*a* as illustrated in FIG. 15. As thus oriented, riser 140 will be aligned with bore 320. Disengagement of riser 140 from cam 143 and engagement of riser 140 within bore 320 upon lowering the riser proceeds in a manner corresponding to that described above with respect to template 100 except that collet fingers 140 engage threaded section 327 of bore 320. Thereafter, a first well 60 is drilled and provided with casing 62 in a corresponding manner to that described above with respect to template 10 and illustrated in FIGS. 5B and 5C.

Riser 140 is released from the well head, placed in tension, and rotated to disengage the threaded external surfaces of collet fingers 147 from threaded section 327 of bore 320 so as to permit riser 140 to be raised into cam 143 and secured thereto by automatically engaging threaded external surface 141 of riser 140 with threaded internal diameter 153 of expandable lock ring 152. The riser is then raised from the surface and engagement of key 292 within slot 148 causes the riser and cam 143 to automatically rotate until key 292 to assumes position 148*b* within slot 148. Subsequent lowering of riser 140 causes the riser and sub to rotate until key 292 is positioned at 148*c* within slot 148. In this orientation, riser 140 will be aligned with bore 330. Disengagement of riser 140 from cam 143 and engagement of riser 140 within bore 330 upon lowering the riser proceeds in a manner corresponding to that described above with respect to template 100 except that collet fingers 147 engage threaded section 337 of bore 330. Thereafter, a second well 70 is drilled and provided with casing 72 in a manner corresponding to that described above with respect to template 10 and illustrated in FIGS. 5D and 5E. Riser 140 is released from the well head, placed in tension, and rotated to disengage the threaded external surfaces of collet fingers 147 from threaded section 337 of bore 320 so as to permit riser 140 to be raised into cam 143 and secured thereto in a manner described above. The riser is raised from the surface and engagement of key 292 within slot 148 causes key 292 to disengage from slot 148 and the riser 140 and orienting cam 143 are raised to the surface. Production casings 66, 76 are thereafter secured to casings 62, 72 or bores 320, 330, respectively, and casings 62, 72 are placed in fluid communication with a hydrocarbon bearing subterranean formation, all in a manner corresponding to that described above with respect to template 10 and illustrated in FIGS. 5F–5I.

EXAMPLE

A drilling rig is skidded over a slot on a conventional monopad offshore drilling platform and a 36 inch diameter bore is drilled from mudline to 450 feet. A 30 inch diameter, 1.5 inch thick casing is positioned within the bore and is cemented therein by conventional cementing techniques. A drill string with a 17.5 inch drill bit is inserted within the 30 inch casing and a 17.5 inch diameter bore is drilled from 450 feet to a 1300 foot depth and is underreamed to 28 inch diameter. A 24 inch diameter, 0.625 inch thick casing string is run to 1300 feet and cemented. A 12.25 or a 14.75 inch pilot bore is directionally drilled to 4500 feet and is underreamed to a 24 inch diámeter. A 20 inch diameter casing having the template of the present invention secured to the lowermost joint thereof is positioned within the 24 inch well bore and is secured to the 24 inch casing by means of a conventional mandrel hanger. The seal section of the lower end of a riser is inserted into the bore through the template which is equipped with a one way valve and cement is circulated through the riser and template to cement the 20 inch casing in the well bore. Any cement remaining within the riser is drilled out and a 8.375 inch directional bore is then drilled to the objective depth by a drill string which is equipped with a conventional mud motor and which is passed through the riser and template. Thereafter, a 7 inch casing which is equipped with a liner hanger is positioned within the 8.375 inch directional bore and secured therein by expanding the liner hanger into engagement with the profile contained within the template bore. The casing is rotated while cement is pumped through the drill string and liner. The riser is then withdrawn from the first bore in the template of the present invention and is inserted into the other bore therethrough. A second 8.375 inch directional bore is drilled and completed via the second bore. The riser is then removed from the well and separate strings of 7 inch casing having a seal assembly secured to the lower end thereof are separately and sequentially inserted into separate template bores and secured to conventional dual completion surface equipment. As thus drilled and completed in accordance with the present invention, a remedial operation can be conducted in one cased well while hydrocarbons are being produced from a subterranean formation to the surface via the other well.

Although the template of the present invention has been illustrated and described as having two or three bores therethrough, it will be evident to a skilled artisan that the template can be provided with more than three bores depending upon the diameter of the bore into which the template is positioned and the diameter of the well bores to be drilled using the template. When more than three bores are provided through the template, one bore which is equipped with a one-way valve will occupy a lowermost position with respect to inclined end face 12 as illustrated in FIG. 1 so that face 12 and collar 43 will function to insert riser 40 into this bore upon being initially inserted into surface or intermediate casing 50.

One or more of the plurality of bores through the template of the present invention may have a substantially vertical axis and/or an axis which is substantially parallel with that of the surface or intermediate casing to which the template is secured. And although these bores have been described and illustrated as diverging from each other along substantially the entire length of the template, it is within the scope of the present invention that such bores may diverge from each other in only one or more corresponding sections thereof and in differing degrees in different sections. Further, although the plurality of bores through the various embodiments of the template of the present invention have been described and illustrated as being divergent, bores which are not divergent are still within the scope of the present invention. In such instance bores of differing lengths, whipstock(s) secured to the template below the bores, and/or means for deviating the drill string emanating from such bores, for example mud motors, can be employed to ensure against well bore interference.

While the foregoing preferred embodiments of the invention have been described and shown, it is understood that the alternatives and modifications, such as those suggested and others, may be made thereto and fall within the scope of the invention.

We claim:

1. A template for drilling and completing multiple subterranean wells from a first casing, said template comprising:

first means for guiding a drill string during drilling and casing during completion of multiply subterranean wells from said first casing, said first means comprising a body having a first end face and at least one second end face and a plurality of axially extending bores therethrough, each of said bores intersecting said first end face and said second end face; and second means for securing said body to said first casing.

2. The template of claim 1 wherein said bores are divergent.

3. The template of claim 1 wherein each of said bores has a first section and a second section which has a smaller diameter than said first section, said first and second sections defining an annular shoulder therebetween.

4. The template of claim 3 wherein each of said bores has a third section which has a smaller diameter than said second section, said second and third sections defining a second annular shoulder therebetween.

5. The template of claim 1 wherein said first end face is inclined with respect to a plane perpendicular to the axis of said first casing to assist in positioning a well bore tubular in one of said bores.

6. The template of claim 1 wherein said body has two axially extending, bores therethrough.

7. The template of claim 6 wherein said two axially extending bores are divergent.

8. The template of claim 6 wherein one of said two bores is longer than the other bore.

9. The template of claim 3 wherein said second section of each of said bores is provided with a profile into which a liner hanger may be expanded so as to secure production casing thereto.

10. The template of claim 1 wherein said means for securing comprises screw threads.

11. The template of claim 1 wherein said means for securing comprises an packer assembly which is attached around the periphery of said body.

12. The template of claim 1 wherein said first casing is surface casing.

13. The template of claim 1 wherein said first casing is intermediate casing.

14. The template of claim 1 wherein said first casing is generally vertical.

15. The template of claim 1 wherein said first casing is deviated.

16. The template of claim 1 wherein said body has at least three axially extending bores therethrough.

17. The template of claim 16 wherein said at least three axially extending bores are divergent.

18. The template of claim 1 wherein said body is unitary.

19. The template of claim 1 wherein said body is comprised of multiple components.

20. The template of claim 19 wherein said body comprises a first section, at least one first tubular member secured to said first section, at least one second tubular member secured to said first section, and means for inhibiting movement of said first and second tubular members.

21. The template of claim 19 wherein said means comprises an elongated frame.

22. The template of claim 21 wherein at least one guide is secured to said frame through which said first or said secured tubular member is positioned.

23. The template of claim 1 wherein said body is generally cylindrical.

24. The template of claim 1 wherein said end faces are generally planar.

25. The template of claim 1 wherein said body has two second end faces, one of said axially extending bores intersecting one of said two second end faces while another of said axially extending bores intersects the other of said two end faces.

26. The template of claim 25 wherein said plurality of axially extending bores have different lengths.

27. A process for drilling and completing subterranean wells via a first casing which extends from the surface of the earth to a predetermined depth, said process comprising:

securing a template having at least two bores therethrough to said first casing;

drilling a first subterranean well bore through one of said bores and into a subterranean formation; and securing a first length of production casing to said template, said first length of production casing extending into said first well bore, said template supporting said first length of production casing.

28. The process of claim 27 further comprising:

securing a second length of production casing to said template, said second length of production casing extending through the first casing to the surface of the earth so as to establish fluid communication between the subterranean formation penetrated by said first well bore and the surface via said first and second lengths of production casing.

29. The process of claim 28 further comprising:

producing hydrocarbons from said subterranean formation penetrated by said first well bore to said surface of the earth via said first and second lengths of production casing.

30. The process of claim 28 further comprising:

positioning production tubing through said first and second lengths of production casing; and sealing the annulus defined between said first length of production casing and said production tubing.

31. The process of claim 30 further comprising:

producing hydrocarbons from said subterranean formation penetrated by said first well bore to said surface of the earth via said production tubing.

32. The process of claim 27 further comprising:
drilling a second subterranean well bore through another of said bores into a subterranean formation; and
securing a third length of production casing to said template, said third length of production casing extending into said second well bore.

33. The process of claim 32 further comprising:
securing a fourth length of production casing to said template, said fourth length of production casing extending through the surface casing to the surface of the earth so as to establish fluid communication between the subterranean formation penetrated by said second well bore and the surface via said third and fourth lengths of production casing.

34. The process of claim 33 further comprising:
producing hydrocarbons from said subterranean formation penetrated by said second well bore to said surface of earth via said third and fourth lengths of production casing.

35. The process of claim 33 further comprising:
positioning production tubing through said third and fourth lengths of production casing; and
sealing the annulus defined between said third length of production casing and said production tubing.

36. The process of claim 35 further comprising:
producing hydrocarbons from said subterranean formation penetrated by said second well bore to said surface of the earth via said production tubing.

37. The process of claim 30 further comprising:
drilling a second subterranean well bore through another of said bores into a subterranean formation; and
securing a third length of production casing to said template, said third length of production casing extending into said second well bore.

38. The process of claim 37 further comprising:
securing a fourth length of production casing to said template, said fourth length of production casing extending through the surface casing to the surface of the earth so as to establish fluid communication between the subterranean formation penetrated by said second well bore and the surface via said third and fourth lengths of production casing.

39. The process of claim 38 further comprising:
producing hydrocarbons from said subterranean formation penetrated by said second well bore to said surface of the earth via said third and fourth lengths of production casing.

40. The process of claim 38 further comprising:
positioning production tubing through said third and fourth lengths of production casing; and
sealing the annulus defined between said third length of production casing and said production tubing.

41. The process of claim 40 further comprising:
conducting a remedial operation via said third and fourth lengths of production casing; and concurrently,
producing hydrocarbons from said subterranean formation penetrated by said first well bore to said surface via said production tubing positioned within said first and second lengths of production casing.

42. The process of claim 40 further comprising:
injecting a fluid into the subterranean formation penetrated by said second well bore via said third and fourth lengths of production casing; and concurrently,
producing hydrocarbons from said subterranean formation penetrated by said first well bore to said surface via said production tubing positioned within said first and second lengths of production casing.

43. The process of claim 40 wherein said subterranean formation penetrated by said first well bore and said subterranean formation penetrated by the second well bore are the same.

44. The process of claim 40 wherein said subterranean formation penetrated by said first well bore is distinct from said subterranean formation penetrated by the second well bore.

45. The process of claim 37 wherein said first casing is surface casing.

46. The process of claim 37 wherein said first casing is intermediate casing.

47. The process of claim 37 wherein said first casing is generally vertical.

48. The process of claim 37 wherein said first casing is deviated.

49. A method of inserting a generally tubular riser into a plurality of bores through a template which is secured to a casing positioned within a subterranean well bore, the method comprising:
positioning within said casing a generally tubular riser which is releasably secured to an orienting cam;
automatically aligning said riser with one of said plurality of bores through the template;
releasing said riser from said cam; and
inserting a portion of said riser within one of said plurality of bores.

50. The method of claim 49 wherein the step of automatically aligning comprises contacting said cam with a key which is secured to said casing, said key and said cam cooperating upon contact to align said riser with said one of said plurality of bores.

51. The method of claim 50 wherein said key is received within a slot in said cam upon contacting said cam and is temporarily received in a first position in said slot.

52. The method of claim 49 further comprising:
releasably securing said portion of said riser within said one of said plurality of bores.

53. The method of claim 52 further comprising:
providing a fluid tight seal between said riser and said one of said plurality of bores.

54. The method of claim 52 further comprising:
removing said portion of said riser from said one of said plurality of bores; and
releasably securing said riser to said cam.

55. The method of claim 54 further comprising:
automatically aligning said riser with another of said plurality of bores through the template;
releasing said riser from said cam; and
inserting a portion of said riser within said another of said plurality of bores.

56. The method of claim 55 wherein the step of automatically aligning said riser with said another of said bores comprises contacting said cam with said key which is secured to said casing, said key and said cam cooperating upon contact to align said riser with said another of said plurality of bores.

57. The method of claim 56 wherein said key is received within a slot in said cam upon contacting said cam and is temporarily received in a second position in said slot.

58. The method of claim 57 further comprising:
releasably securing said portion of said riser within said another of said plurality of bores.

59. The method of claim 58 further comprising:
providing a fluid tight seal between said riser and said another of said plurality of bores.

60. The method of claim 58 further comprising:
removing said portion of said riser from said another of said plurality of bores; and
releasably securing said riser to said cam.

61. The method of claim 60 further comprising:
removing said riser and said cam from said casing.

62. The process of claim 27 wherein said at least two bores through said template are divergent.

63. A subterranean well system comprising:
a first well bore extending from the surface of the earth to a predetermined depth;
a second well bore drilled from the first well bore into a first subterranean formation;
a third well bore drilled from the first well bore into a second subterranean formation;
a first length of production casing extending from the surface of the earth, through said first well bore and into said second well bore so as to establish fluid communication between said first subterranean formation and the surface; and
a second length of production casing extending from the surface of the earth through said first well bore, and into said third well bore so as to establish fluid communication between said second subterranean formation and the surface.

64. The system of claim 63 further comprising:
production tubing positioned within said first length of production casing and extending from the surface of the earth into said second well bore.

65. The system of claim 64 further comprising:
means for sealing the annulus defined between said first length of production casing and said production tubing.

66. The system of claim 63 further comprising:
production tubing positioned within said second length of production casing and extending from the surface of the earth into said third well bore.

67. The system of claim 66 further comprising:
means for sealing the annulus defined between said second length of production casing and said production tubing.

68. The system of claim 63 wherein said first well bore is generally vertical.

69. The system of claim 63 wherein said first well bore is deviated.

70. The system of claim 63 wherein said first and said second subterranean formations are the same formation.

71. The system of claim 63 wherein said first subterranean formation is distinct from said second subterranean formation.

72. The system of claim 63 further comprising:
a fourth well bore drilled from the first well bore into a third subterranean formation; and
a third length of production casing extending from the surface of the earth, through said first well bore and into said fourth well bore so as to establish fluid communication between said third subterranean formation and the surface.

* * * * *